US005658211A

United States Patent [19]

Glover

[11] Patent Number: 5,658,211

[45] Date of Patent: Aug. 19, 1997

[54] INTERACTIVE BALL THROWING GAME

[76] Inventor: Clinton G. Glover, 2556 Linda Vista, Clarkston, Wash. 99403

[21] Appl. No.: 536,806

[22] Filed: Sep. 29, 1995

[51] Int. Cl.[6] ..... A63B 63/00; A63B 71/00

[52] U.S. Cl. ..... 473/422; 473/431; 473/446; 473/455; 473/478; 273/396

[58] Field of Search ..... 473/421, 422, 473/446, 451, 454, 455, 416, 417, 439, 468, 447, 472, 477, 478, 433, 481, 485, 431, 432, 434, 435, 436; 273/394, 395, 396, 397

[56] References Cited

U.S. PATENT DOCUMENTS

| | | | |
|---|---|---|---|
| 1,144,472 | 6/1915 | Harberson | 473/421 |
| 1,924,757 | 8/1933 | Shisoff | 473/433 |
| 1,927,876 | 9/1933 | Meyer | 273/366 |
| 2,082,818 | 6/1937 | Atwell | 473/436 |
| 2,251,305 | 8/1941 | Tarbox | 473/455 |
| 3,467,380 | 9/1969 | Bonacci | 473/439 |
| 3,776,550 | 12/1973 | McNabb | 473/436 |
| 4,323,047 | 4/1982 | McIntosh | 124/81 |
| 4,913,427 | 4/1990 | Wilson | 473/432 |

*Primary Examiner*—Sebastiano Passaniti

*Attorney, Agent, or Firm*—Wells, St. John, Roberts, Gregory & Matkin P.S.

[57] ABSTRACT

An interactive throwing game apparatus and method includes a longitudinal game table provided in an arcade game environment. An upright ball target is mounted across the front end of the game table at a location facing a human player standing at a player station adjacent to the rear end of the apparatus. A pitching mechanism recessed beneath the game table ejects individual balls toward the human player, who then attempts to throw each ball to a defined target. The object of the game is to cause the ball to impact the target area before a simulated runner visible along the game table reaches a finishing position adjacent to the ball target. Visual and audible messages are provided to the human player dependent upon the accuracy of each throw and the timed sequence at which a given ball impacts the target area in relation to the movement of the simulated runner.

43 Claims, 20 Drawing Sheets

INTERACTIVE BALL THROWING GAME

TECHNICAL FIELD

This invention relates to amusement games for arcade usage. More specifically it pertains to an interactive ball throwing game wherein a human player first catches a ball thrown automatically toward the player. He or she then tries to throw it at a fixed target before a mechanized game figure completes movement along a path leading near the target. With respect to baseball, it simulates a "squeeze play" at home plate.

BACKGROUND OF THE INVENTION

Electromechanical arcade games have become increasingly complex and sophisticated in recent years. Many newer games try to simulate real life and sports events. They also have become increasingly interactive, with the machinery and the human player cooperatively or competitively playing out a variable sequence of sporting events.

The present invention arose from a desire to simulate a baseball "squeeze play" within the physical limitations and confines of a typical arcade game environment.

A "squeeze play" in the game of baseball is a prearranged play wherein a runner at third base starts running for home plate as the ball is pitched. The batter attempts to bunt to give the runner time to score. The defensive fielding team in turn attempts to put the runner "out" by quickly catching the bunted ball and throwing it to the catcher at home plate before the runner reaches it. Its strategic use is most exciting to fans and usually crucial to the progress of the game, since a successful runner is credited with a "run" that directly adds to the score of the offensive team. Conversely, by successfully defeating a "squeeze play" at home plate, the defensive team averts the score.

The present arcade game has been designed to challenge the ability of a human player to rapidly catch and throw a ball accurately to a target under simulated squeeze play conditions. The human player tries to successfully throw at a target before a visible "runner" completes a path of movement along the game table in front of the player. These actions can be effectively coordinated with both visible and audible sound signals to simulate the crowd noises and player banter that typically take place during such events at an actual baseball game.

BRIEF DESCRIPTION OF THE DRAWINGS

Preferred embodiments of the invention are described below with reference to the accompanying drawings, which are briefly described below.

FIG. 7 is a skeletal diagrammatic side view illustrating the basic components in the arcade game;

FIG. 12 is an enlarged sectional view taken along line 12—12 in

FIG. 10;

FIG. 16 is a fragmentary plan view taken just beneath the game table, showing the simulated runner mechanism;

FIG. 17 is a fragmentary sectional view taken along line 17—17 in FIG. 16;

DETAILED DESCRIPTION OF THE PREFERRED EMBODIMENTS

Figure 1:
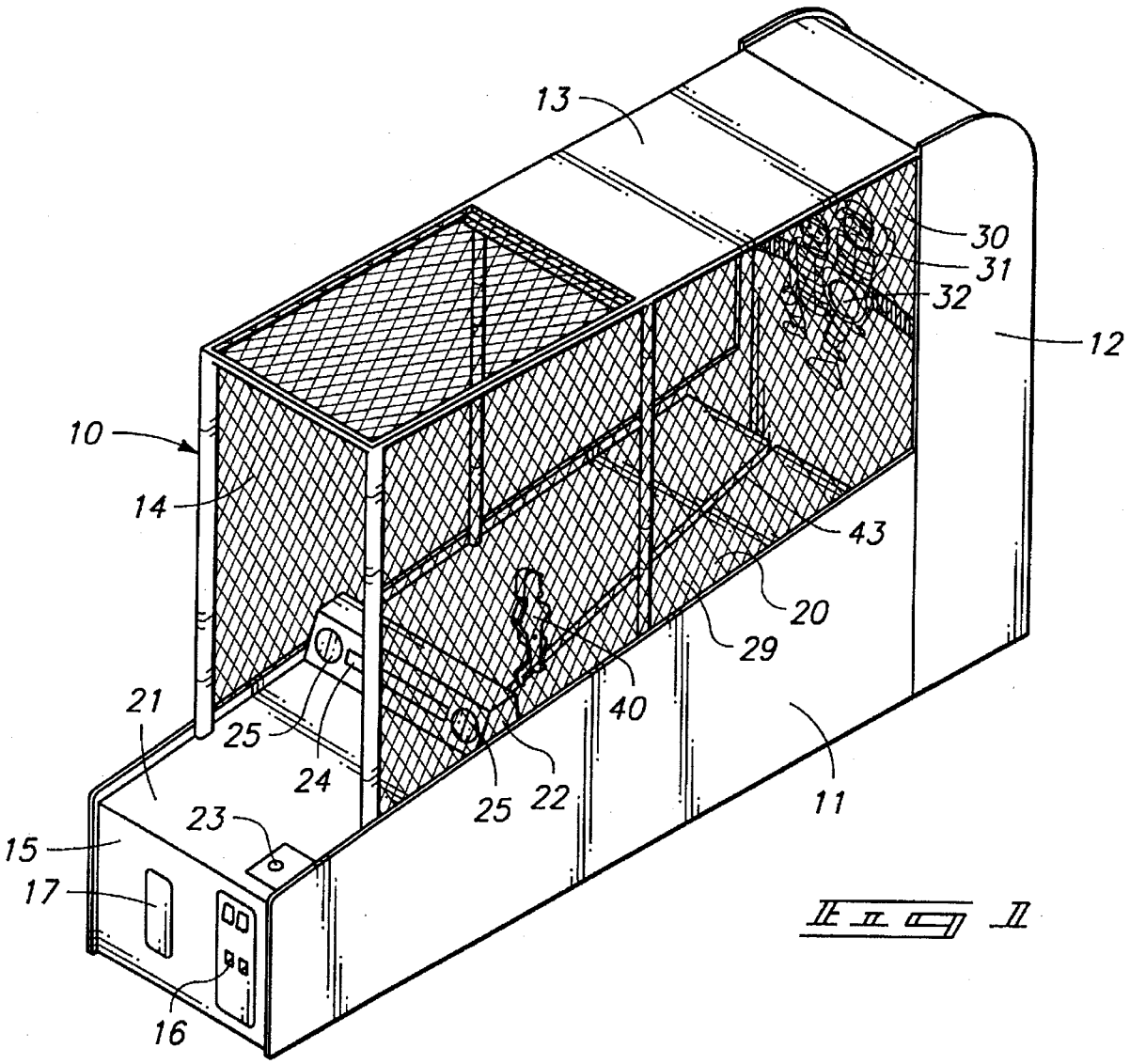
FIG. 1 is a perspective view of the arcade game.
Figure 2:
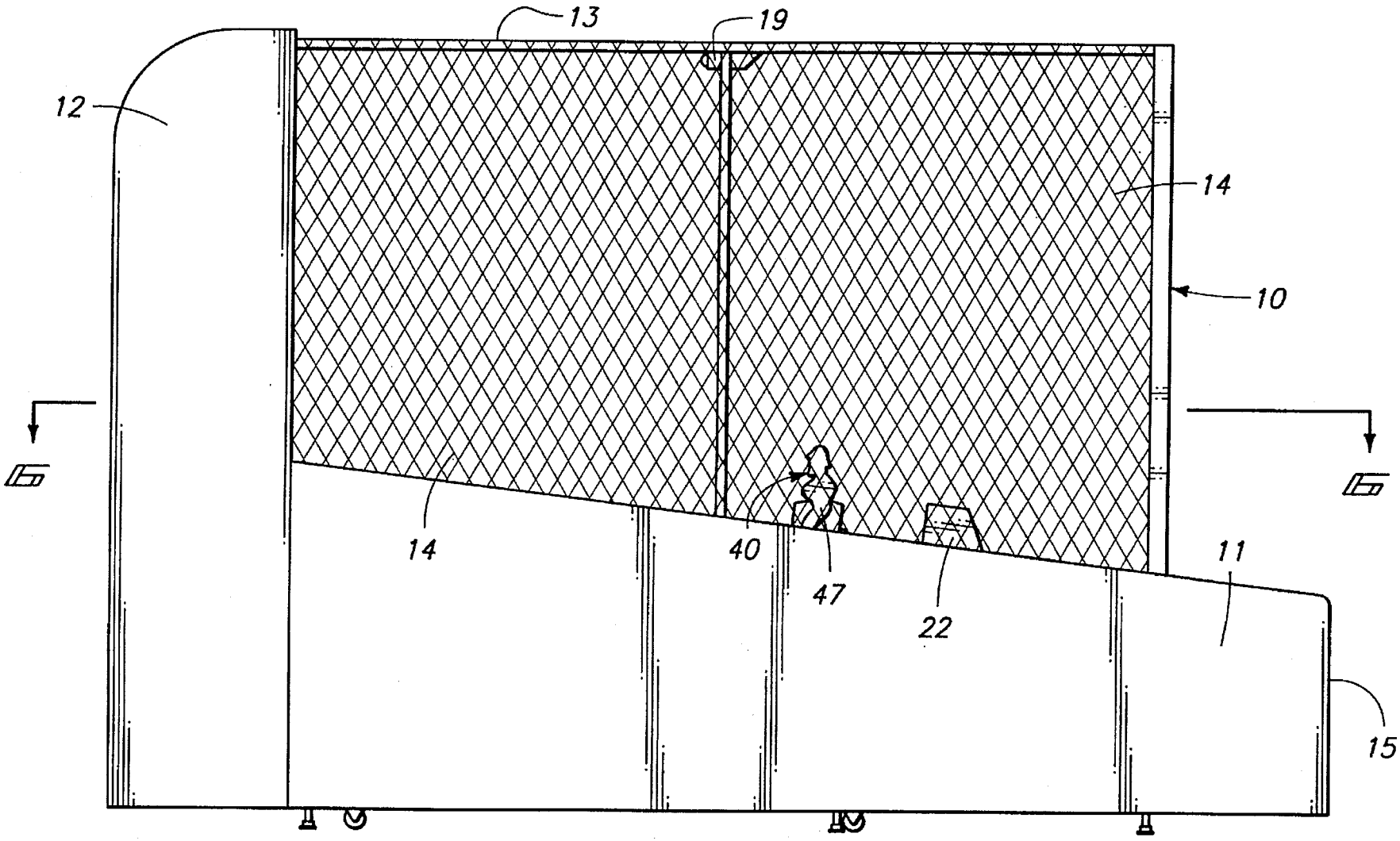
FIG. 2 is a side elevation view.

This disclosure of the invention is submitted in furtherance of the constitutional purposes of the U.S. Patent Laws "to promote the progress of science and useful arts" (Article 1, Section 8).

The present interactive throwing game has been designed specifically to simulate the activities that occur during a "squeeze play" at home plate in the game of baseball. However, it could be revised to simulate other activities wherein a ball is caught or otherwise grasped by a human player and immediately is thrown at a target in a timed sequence coordinated with visible action along a path leading toward the target. Other simulations might or might not be related to sports events.

The key element of this arcade game is the requirement that the human player catch or grasp a ball and successfully toss it at an identifiable target before completion of a moving visible event occurring in sight of the human player. While the following description will relate the components of the arcade game to the game of baseball, it is to be understood that this is not a limitation of the disclosure.

A general understanding of the arcade game can be obtained from FIGS. 1–7, and specifically from FIG. 7, which shows a playing ball at several progressive positions about the game apparatus in a sequence illustrating the manner in which the arcade game is played.

For verbal reference, the arcade game is housed within an enclosure and framework that have longitudinal lengths and transverse widths. Their lengths extend from rearward ends adjacent to a player station at which a human player will normally be standing (shown to the right in FIG. 2) to a forward ends at which a ball target is mounted (shown to the left in FIG. 2). The terms "rearward," "back," and "rear" and the terms "forward" and "front" will be used consistently within this disclosure and the appended claims in relation to the described longitudinal ends of the illustrated enclosure as set out in the preceding sentence.

To generally summarize the playing sequence of the game, reference will be made to the schematic illustration in FIG. 7. The arcade game is designed to be played by a human player (not shown) facing forwardly at the right hand (rearward) end of a supporting framework 10. All playing activity of the human player takes place in a forward direction along the framework 10.

Play is initiated by operation of a ball release 57 that directs a ball 18*a* into the bottom of an upright ball discharge mechanism 50.

The ball discharge mechanism 50 delivers individual balls 18*b* to the human player by tossing each ball through an upwardly inclined game table 20 in a trajectory directed toward the rearward end of the apparatus.

As each ball 18*a* is delivered by the ball release 57 to the ball discharge mechanism 50, a simulated runner 40 begins movement along the game table 20 toward a ball target 30. Runner 40 moves between a starting position 40*a* adjacent to the player station and a finishing position 40*b* adjacent to the ball target 30.

The object of this game is for the human player to catch the ball moving toward him or her at 18*b* and immediately toss it accurately through the ball target 30 (as shown by ball 18*c*) before the simulated runner 40 reaches its finishing position 40*b*. Whether or not a ball is successfully thrown through the ball target 30, each ball 18*d* is returned along a gravity ball return 60 leading to the ball release 57.

Figure 3:
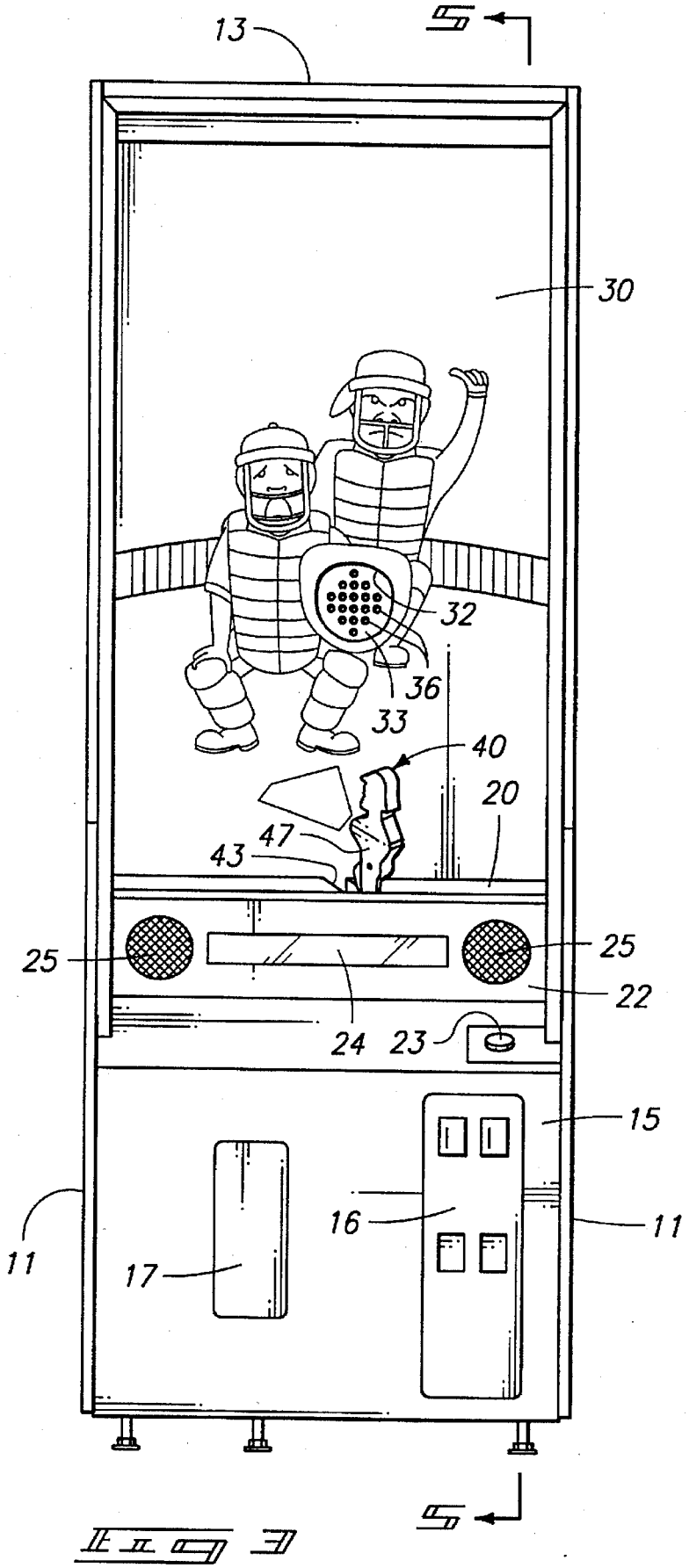
FIG. 3 is a rear view taken from the right in FIG. 2.

The rear surface of the ball target 30, which can be seen in FIG. 3, is preferably decorated to illustrate a defensive baseball catcher and umpire stationed at home plate during a baseball game. The ball target 30 includes a ball-receiving aperture 32 located within the boundaries of a catcher's mitt portrayed on the painted backdrop 31.

During play of the game, the moving simulated runner 40 travels in a direction leading diagonally away from the human player standing at the rearward end of framework 10. At the end of its movement, the runner 40 pivots downwardly and forwardly to simulate a running offensive player sliding toward home plate.

In addition to the physical handling of each ball by the human player and the timed challenge presented by movement of the simulated runner 40, the game apparatus uses both sound, lights, messages and other sensory responses to impart realism, excitement and motivation to the game activities as they unfold. An audible or visual signaling module 22 extends across an intermediate transverse location along the game table 20. The signaling module 22 might include a controllable LED display 24 and speakers 25 which can be operated in a coordinated manner to provide background crowd sounds, encouragement or taunts from simulated game players, and congratulatory messages when a ball has been successfully thrown to the target in the required timed sequence. Other lights and speakers can be arranged about the framework 10 as desired.

Figure 20:
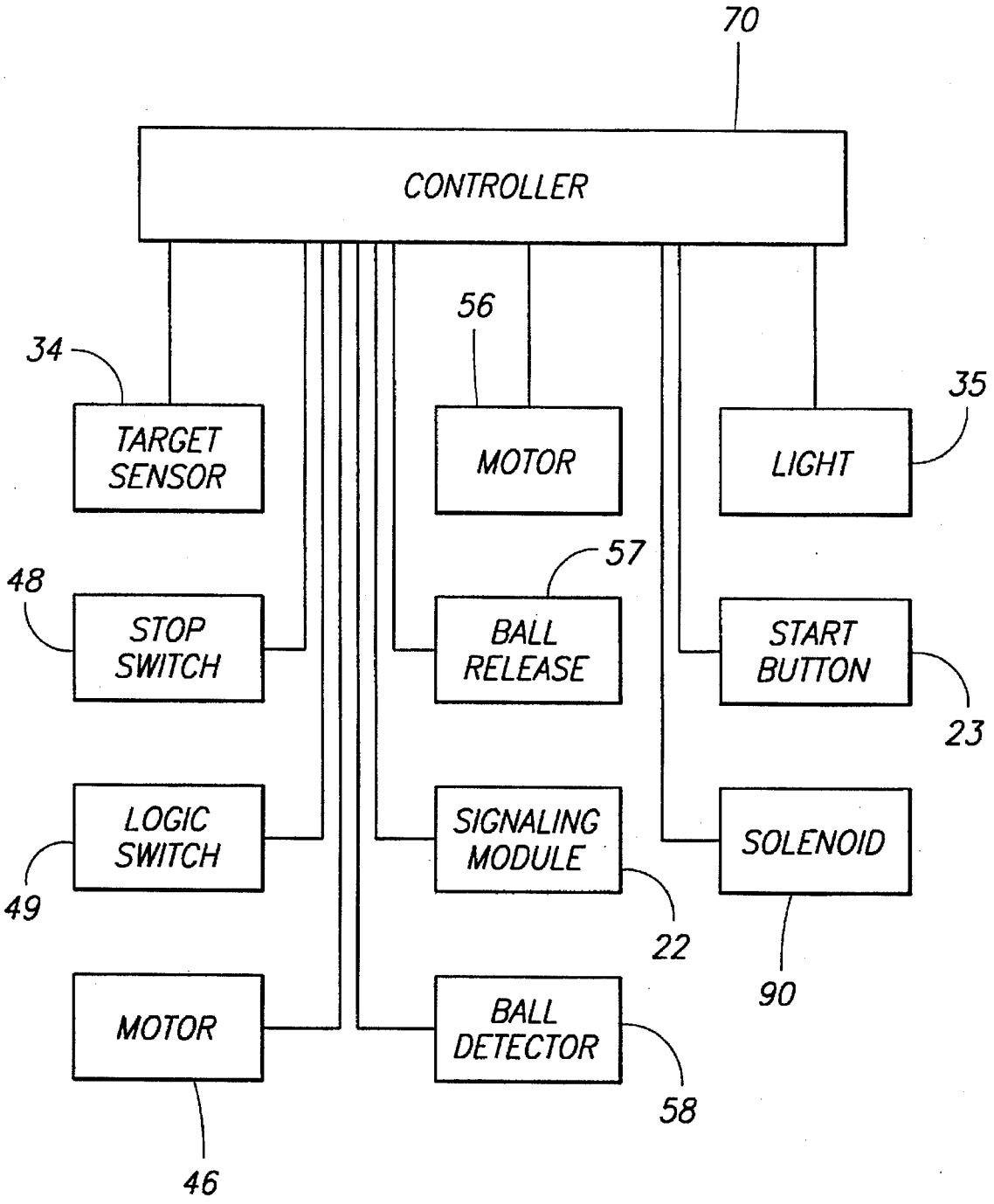
FIG. 20 is a block diagram of the controller and associated electrical components for the game apparatus.

Operation of the various components included in this interactive arcade game are managed by a programmed controller 70. Its interconnections to the various sensors, motors, controls and other components are schematically illustrated in FIG. 20.

The method for playing the interactive throwing game basically involves provision of a longitudinal game table 20, extending between a rearward end adjacent to a player station and a longitudinally spaced forward end. It further involves locating an upright ball target 30 across and elevationally above the forward end of the game table 20.

Individual balls 18 are selectively delivered toward the rearward end of the game table for use by a human player (not shown), who then attempts to aim and toss each ball successfully to the ball target 30. At the same time, a simulated runner 40 is moved along a longitudinal path 43 on the game table 20. The runner 40 moves along game table 20 between a starting position adjacent to the player station and a finishing position adjacent to the ball target 30. Movement of the runner 40 along its path from its starting position is initiated in response to initiation of the delivery of each ball 18.

The method further involves the step of sensing when a ball has been successfully thrown to the ball target 30 and a determination as to whether this occurs prior to the simulated runner 40 reaching its finishing position. This information is then communicated to the human player by activation of audio/visual signaling module 22. The selected message information communicated is dependent upon whether or not a sequence of play was achieved whereby the ball was successfully thrown to the ball target 30 prior to the simulated runner 40 reaching its finishing position.

The arcade game process additionally includes the step of ejecting individual balls in a longitudinal trajectory extending rearwardly over the game table 20 and toward the player station. This occurs at a longitudinal location along the game table 20 that is intermediate its rearward and forward ends. Furthermore, the balls have backspin imparted to them as they are ejected. Backspin minimizes bouncing of each ball 18 on the game table 20 if the ball is not initially caught on the fly by the human player.

The delivery of each ball is achieved by continuously operating a ball conveyor having a working flight that ejects the individual balls 18. Individual balls 18 are selectively directed onto the working flight as the game cycle progresses. The step of initiating movement of the simulated runner occurs simultaneously as each ball 18 is directed onto the working flight of the discharging ball conveyor.

The interactive throwing game illustrated in the drawings is supported upon a rigid framework 10 extending longitudinally from the player station at the longitudinal rear of the game apparatus. A human player at the player station faces the apparatus while in a standing position with his or her hands free to catch each ball 18 as it is ejected toward the player station.

The framework supports vertical side walls 11, a forward enclosure 12, and a solid top panel 13. Screens 14 enclose the sides and top of the ball throwing area, while permitting visual access by onlookers.

The game enclosure includes a rear wall 15 that supports a conventional coin operated control mechanism 16 and a conventional ticket dispenser 17. The coin operated control mechanism 16 is used to receive coins as required for game playing purposes. Ticket dispenser 17 provides prize coupons to a player in response to game results.

Figure 5:
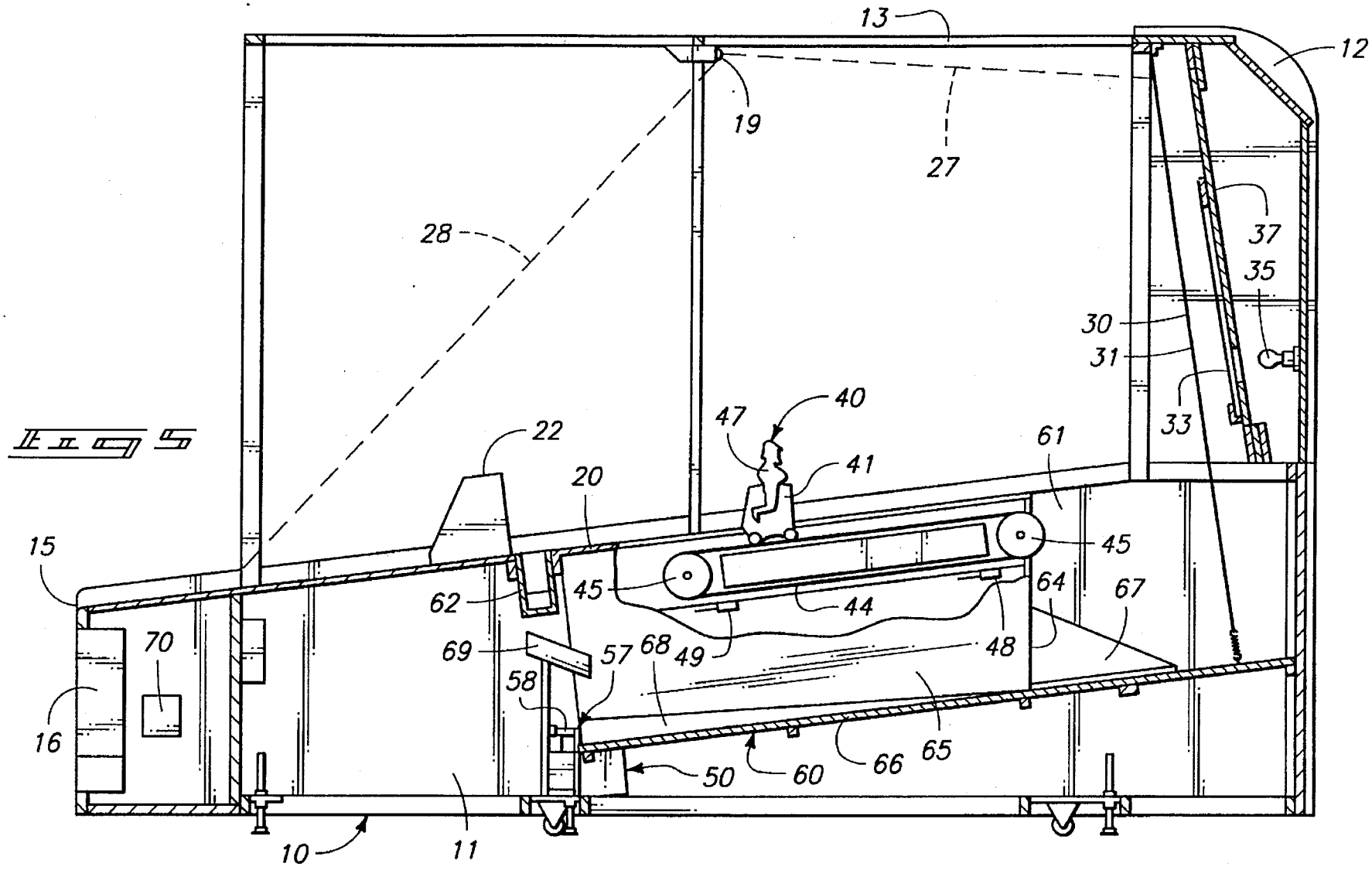
FIG. 5 is a sectional side view taken along line 5—5 in FIG. 3.

A transverse fluorescent lamp assembly 19 is fixed across the top of the framework above the longitudinal center of game table 20. It includes a rearwardly facing tube and a transverse supporting fixture that evenly directs light across the ball target 30 and the game table 20. Light from the activated fluorescent tube extends rearwardly and across the surface of the game table 20 at a location forward from the player station. The lighting boundaries across the equipment are indicated in FIG. 5, which shows the upper lighting boundary at 27 and the rearward lighting boundary at 28.

In this manner the ball target 30 and game table 20 are flooded with light that also covers the rearward trajectory of each ball ejected from the ball discharge mechanism 50. However, the light source at lamp assembly 19 is shielded from the eyes of the human player standing at the apparatus. Lamp assembly 19 will normally be continuously lighted to draw attention to the equipment and make it enticing to prospective human players.

The game table 20, which transversely spans framework 10 and is fixed to it, is inclined upwardly between its rearward and forward ends. It includes primary and secondary areas 29 and 21, which are separated by the transverse audible or visual signaling module 22. Both areas 29 and 21 are identically inclined within a common plane and together form the game table 20. For visual effect, the primary area 29 of game table 20 can be covered with synthetic turf or it might be appropriately painted to simulate the playing surface of a baseball diamond or any other selected playing surface design.

Visual displays 24 on the rear face of the audible or visual signaling module 22 are preferably inclined upwardly at an angle to the game table 20 so as to be easily readable by the human player during game operation. The speakers included within the audible or visual signaling module 22 are also aimed at the human player so as to provide sufficient sound levels for effectiveness, while directing sound to a narrow playing location so as to not unduly disrupt adjacent games.

A manually operable start button 23 is provided at the right hand rear corner of the secondary area 21 along game table 20. By depressing button 23, a human player manually initiates a game playing cycle. No other human intervention is required during the cycle other than catching and throwing the balls 18 as they are ejected toward the human player.

As can be seen in FIGS. 3, 5 and 13–15, the ball target 30 comprises a tensioned flexible backdrop 31 capable of absorbing the impact of a ball without imparting a substantial rearward bounce to it. Backdrop 31 is yieldably suspended by attachments across its upper end and by upright tension springs attached to the framework 10 across its lower end.

The backdrop 31 is positioned in an upwardly and rearwardly inclined transverse location spaced forwardly from the forward edge of game table 20. Thus, balls that miss the aperture 32 formed through the backdrop 31 will be deflected rearwardly and dropped in a downward direction between backdrop 31 and game table 20.

A ball 18 that passes through the aperture 32 in the inclined backdrop 31 will strike a similarly inclined transverse impact plate 33. See FIGS. 5, 7 and 13. The impact plate 33 is movably mounted on an access door 37 fixed across the front end of framework 10. An associated target sensor 34 will be activated when a ball has been successfully thrown to the ball target by a human player and engages the impact plate 33. Even slight movement of impact plate 33 will be sufficient to activate target sensor 34, as will be described in detail below.

Figure 14:
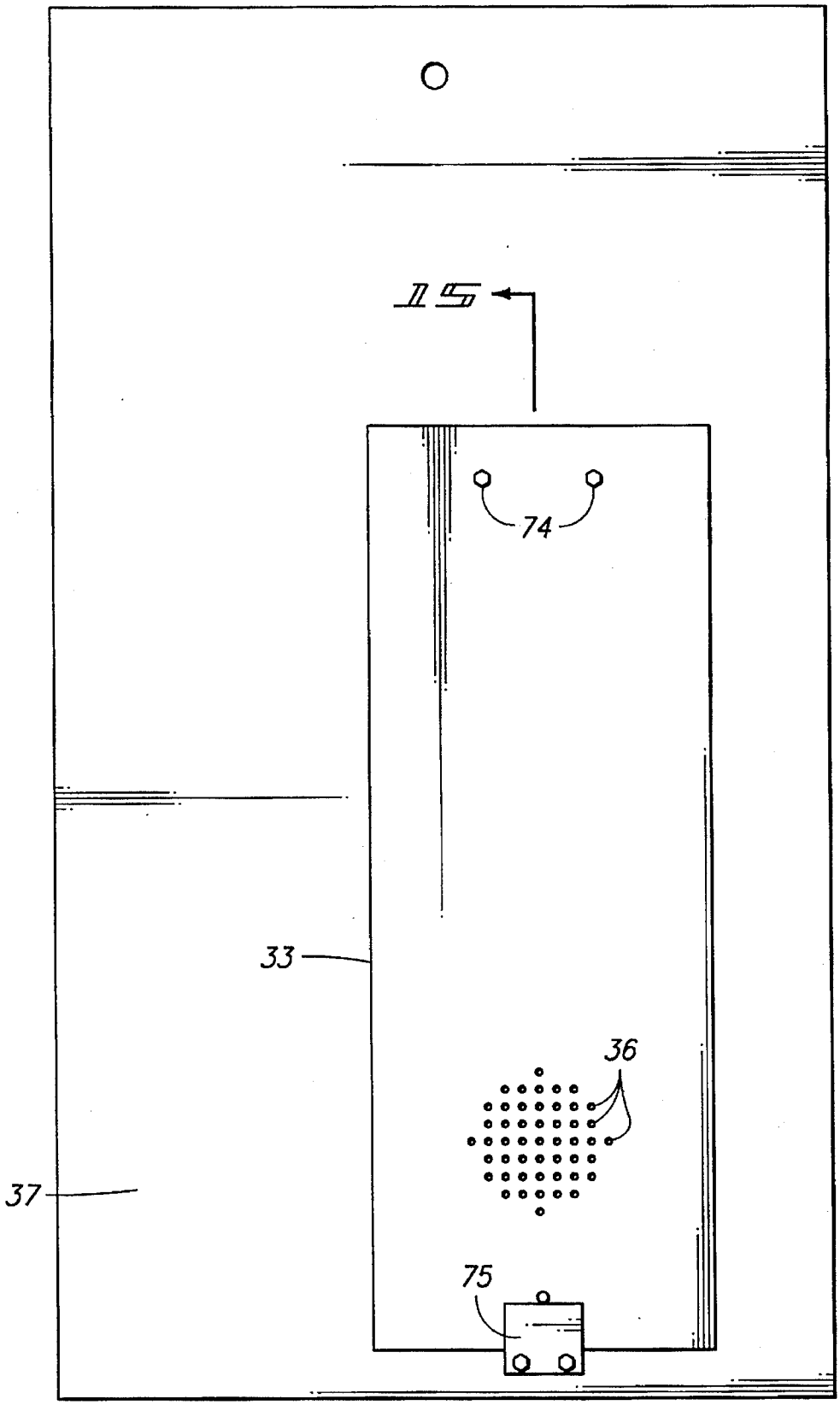
FIG. 14 is a rear view of the impact plate assembly.

In the illustrated embodiment, impact plate 33 has a series of small apertures 36 formed through it. As can be seen in FIG. 14, apertures 36 are located within the area of impact plate 33 immediately forward of the aperture 32 formed through backdrop 31. A controllable light source 35 is located on framework 10 forward of the access door 37. In turn, the access door 37 includes a translucent window 38 (FIG. 15) forward of the apertures 36 of impact plate 33. The window 38 can be any color, but is preferably colored red to attract maximum visual attention by a human player using the game.

During game operation, it is preferable that light source 35 be activated simultaneously with the ejection of each ball toward the human player. The light source 35 should be deactivated during each playing cycle at the time that the simulated runner 40 reaches its finishing position along the game table 20. The intermittently lighted target area defined by the apertures 36 focuses the attention of the human player on the desired target location. The fact that it is lighted in synchronism with the delivery of each ball 18 lends additional visual "action" to the game sequence.

The simulated runner is generally visible in FIGS. 1, 2, 5 and 7. It is further detailed in FIGS. 16–19. It includes a runner support 41 movably mounted on the framework 10 by an endless belt 44 and front and rear pulleys 45. The upper flight of belt 44 comprises a working conveyor flight recessed below and parallel to the game table 20.

Figure 19:
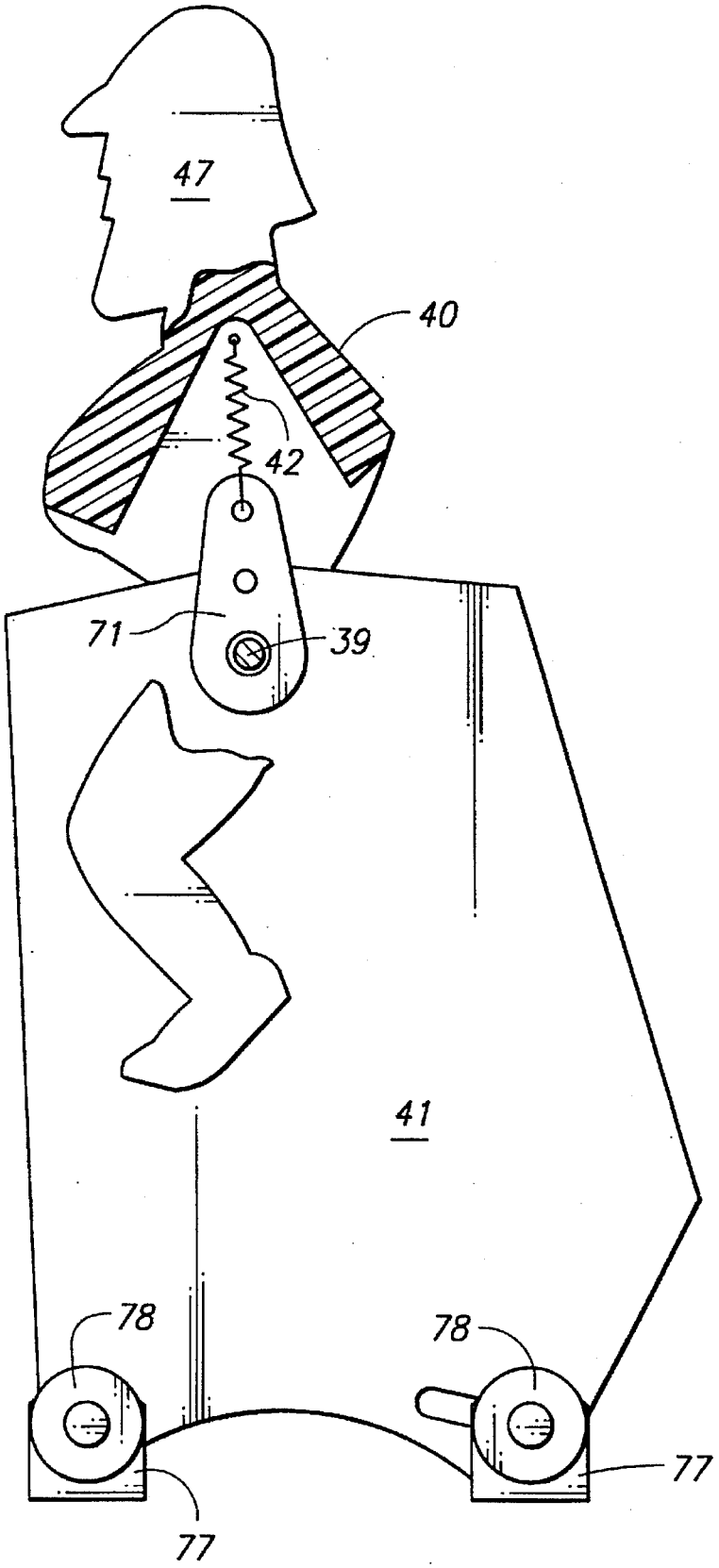
FIG. 19 is an enlarged fragmentary side elevation view of the runner figure as seen along line 19—19 in FIG. 18.

A simulated running FIG. 47 is pivotally supported about a transverse axis on the runner support 41. The pivot shaft about which the FIG. 47 rocks is shown in FIG. 19 at 39.

The running FIG. 47 is biased to an upright position relative to the runner support 41 by a tension spring connected between it and a vertical spring bracket 71. Bracket 71 is aligned above the pivot shaft 39 and fixed to the runner support 41. Spring 42 normally maintains the running FIG. 47 in an upright position. However, it permits the running FIG. 47 to rock longitudinally if and when it is accidentally struck by a thrown ball 18.

In addition, the light biasing forces imparted to running FIG. 47 by spring 42 allow running FIG. 47 to rock slightly back and forth about pivot shaft 39 in response to movement imparted to the running figure 47 by translational motion of belt 44. This improves the visual simulation of a runner travelling along a base path in front of the human player using the game.

Figure 6:
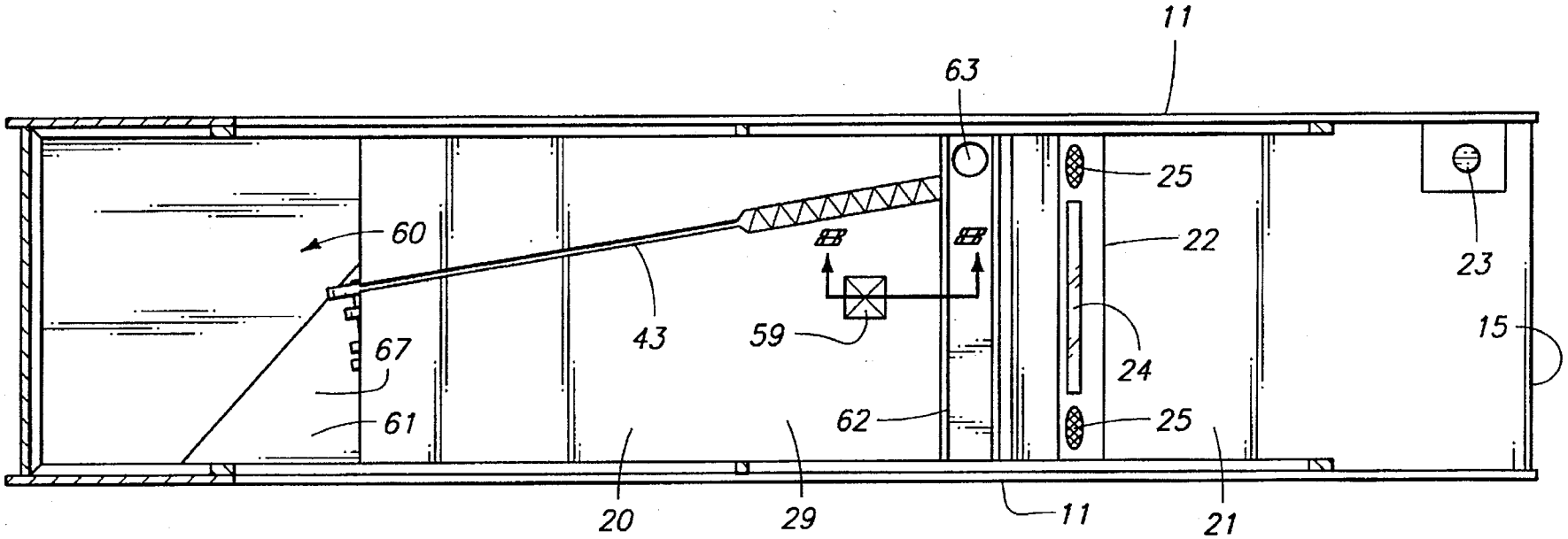
FIG. 6 is a sectional plan view taken along line 6—6 in FIG. 2.

The simulated runner 40 travels along a straight path that extends at an acute angle relative to the longitudinal length of game table 20. The angular orientation of the slotted path 43 is best seen in FIG. 6. It provides greater visibility to the running FIG. 47 on the part of a human player. The slot width across game table 20 along the path 43 is relatively narrow immediately above the endless belt 44. the only dimensional requirement along this section of path 43 is that the upright vertical runner support 41 must freely pass through the slot width.

The rearward end of the slotted path 43 is widened to permit passage of the wider running FIG. 47 as it moves upwardly over the rear supporting pulley 45 that supports endless belt 44. The widened slot area can be covered by an interlaced flexible cover made from plastic sheeting capable of opening to permit passage of running figure 47. The lightly biased covering should readily close to eliminate any substantial visual interruption of the primary area 29 along the game table 20. There is no need for a widened slot configuration at the front end of game table 20, since the running FIG. 47 can pass downwardly about the front belt-supporting pulley 45 within the open space that separates game table 20 and ball target 30.

Two controlling switches are located adjacent to the path of running FIG. 47. The first is indicated in FIG. 5 as a stop switch 48 that detects running FIG. 47 after it has passed over the front pulley 45. Stop switch 48 sends a signal to controller 70 indicating that running FIG. 47 has reached its finishing position. The second is a logic switch 49 located in the path of the moving running figure 47 adjacent to the rear pulley 45. It sends a signal to controller 70 that initiates a time delay, after which operation of motor 46 is terminated with the running FIG. 47 positioned above game table 20 in an upright orientation at its starting position.

Figure 8B:
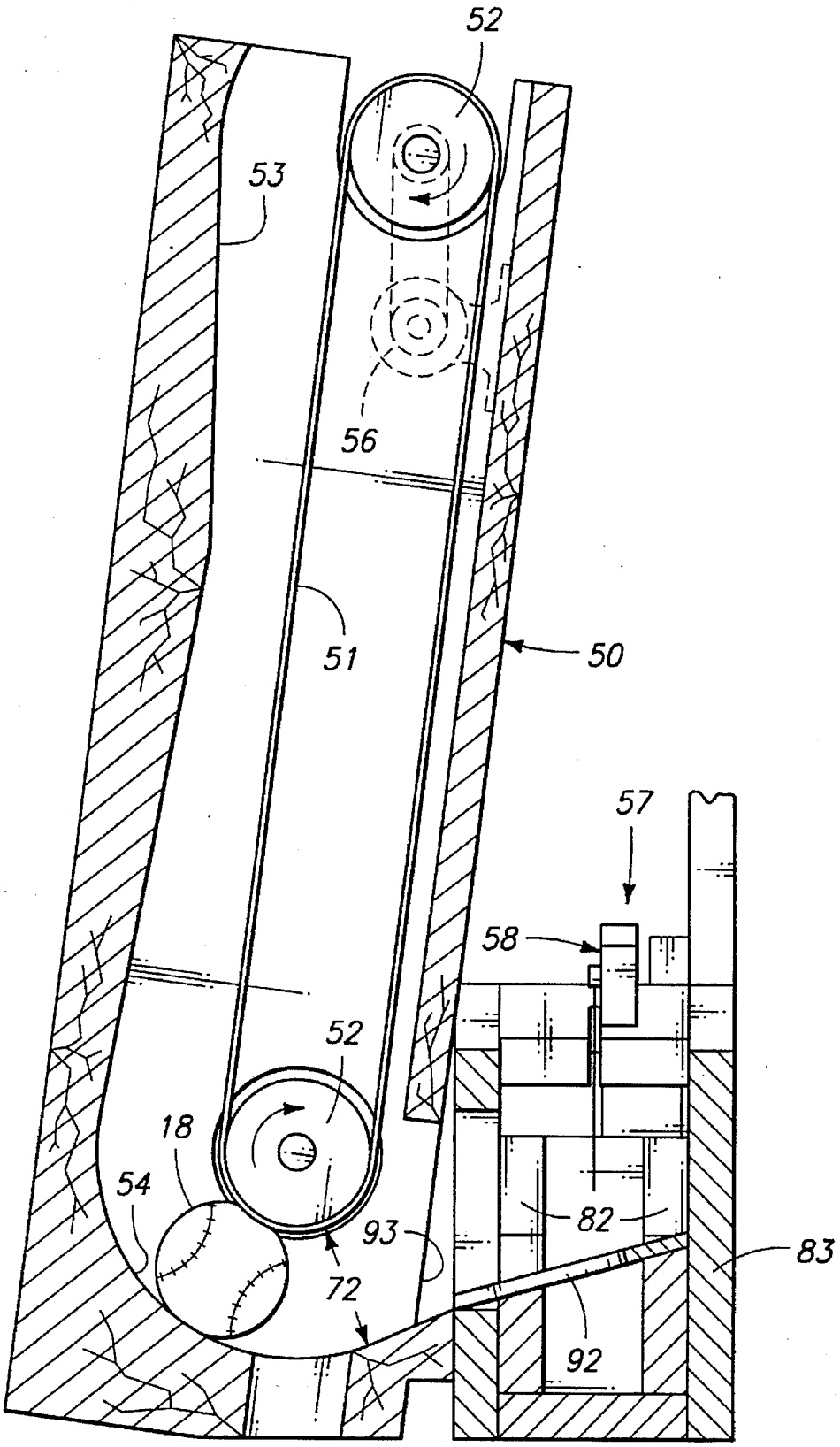
FIG. 8 is an enlarged fragmentary side sectional view of the ball pitching machine as seen along line 8—8 in FIG. 6.
Figure 9:
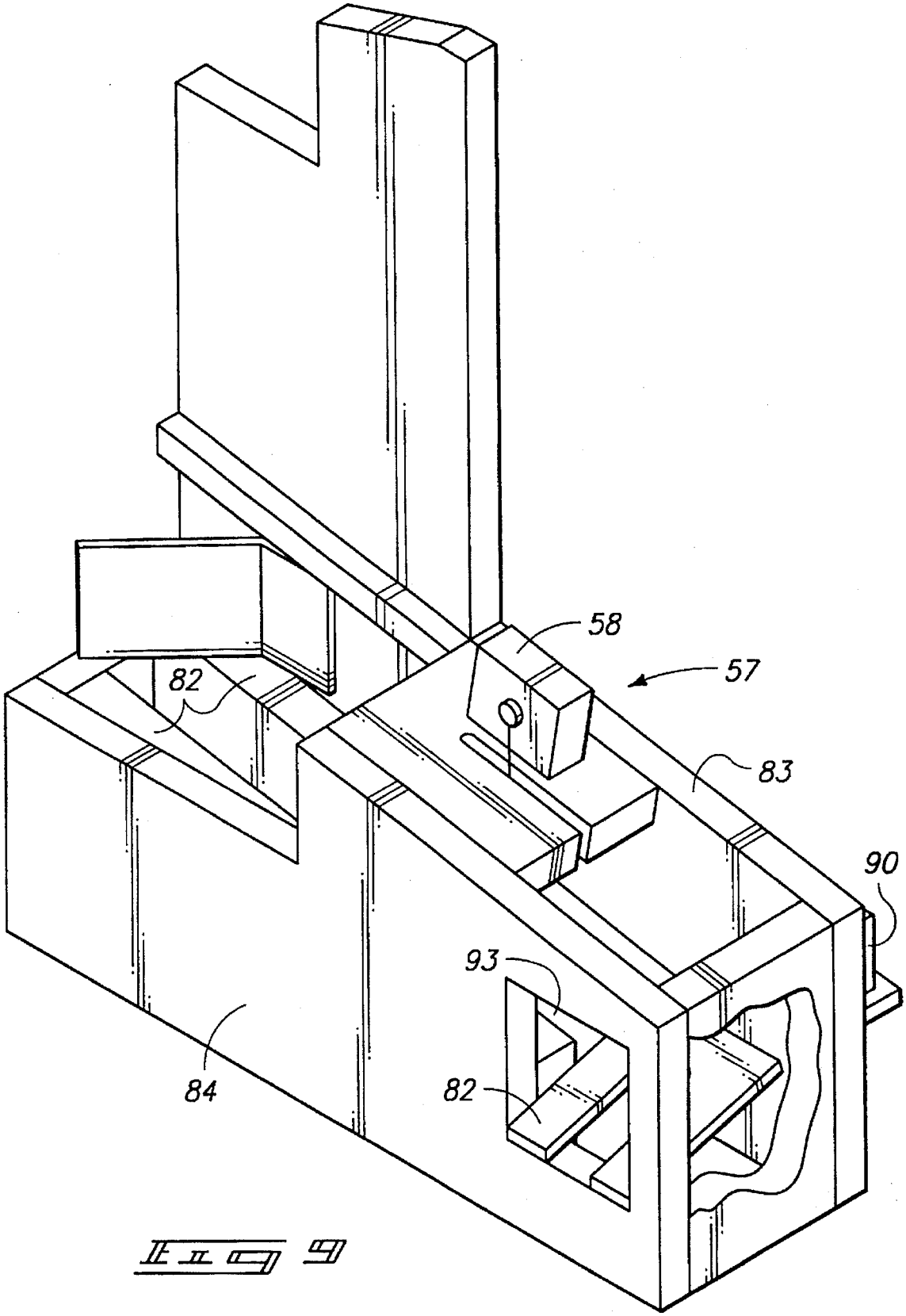
FIG. 9 is a perspective view of the ball release.

The ball discharge mechanism 50 is a pitching machine recessed under the game table 20 at a location identifiable by a slotted flexible cover 59 seen in FIG. 6. Details of the pitching machine are shown in FIG. 8. Details of the ball release 57 are shown in FIGS. 9–12 and will be described in detail below.

For safety reasons, the balls 18 should not be real baseballs or other rigid playing balls which might injure a human player or adjacent observers, and which might inflict damage on the moving components of the game apparatus. Each ball has a nominal diameter achieved while in a normal, uncompressed spherical state.

The ball discharge mechanism 50 comprises a ball conveyor that is continuously operated during each game playing cycle. It has a working flight (shown to the left in FIG. 8), for ejecting individual balls in a longitudinal rearward trajectory that extends over the game table.

The ball conveyor includes a flexible belt 51 stretched between upper and lower pulleys 52 mounted about supporting shafts at fixed locations on the framework 10.

An opposed stationary surface 53 on the framework 10 overlies at least a portion of the working flight of belt 51 and is spaced from it by a dimension that is slightly less than the nominal ball diameter. To assure against inadvertent or improper use of a rigid conventional ball while playing this simulated game, the stationary surface 53 is merged into a cylindrical lower zone. This cylindrical zone is wrapped about the lower pulley 52 at a spacing less than the nominal diameter of a ball. The lower end of surface 53 is arcuate and separately indicated at 54. It is generated about the transverse axis of the lower pulley 52 and is outwardly spaced from the lower end of belt 51 wrapped about the bottom pulley 52.

The reduced spacing between belt 51 and the lower cylindrical surface 54 is indicated in FIG. 8 by line 72. By making the dimension along line 72 less than the nominal ball diameter, entry of a conventional rigid ball into the moving ball conveyor is physically prevented.

As a compressed ball 18 is moved upwardly along the belt 51, the spacing between belt 51 and surface 53 is gradually reduced. This causes the ball 18 to roll along the surface 53 with a gradually increasing pressure, the belt 51 being deflected between the engaging pulleys 52 by the compressed rolling balls. The separation between belt 51 and surface 53 is then slightly increased to allow the rolling ball to pass over the top pulley 52, where it is deflected rearwardly and lobbed at a relatively slow speed toward the rearward end of the game apparatus.

The backspin imparted to each ball 18 by the rolling action within the ball discharge mechanism 50 helps to retain the ball within the confines of the game apparatus if it is not caught on the fly by the human player. It also reduces the extent of vertical bounce that will be imparted to ball 18 as it comes down on the secondary area 21. The human player can either catch the ejected balls before or after they engage the secondary area 21 along game table 20.

The upper pulley 52 is powered by motor 56 and a coupling drive belt. As previously indicated, motor 56 is continuously operated during each game playing cycle.

Individual balls are delivered to the ball conveyor by a ball release 57. It is detailed in FIGS. 9–12, and will be further described below. It includes a ball detector 58 in the form of a switch which is actuated whenever a ball is in place within the ball release and ready for delivery to the ball conveyor.

Figure 13:
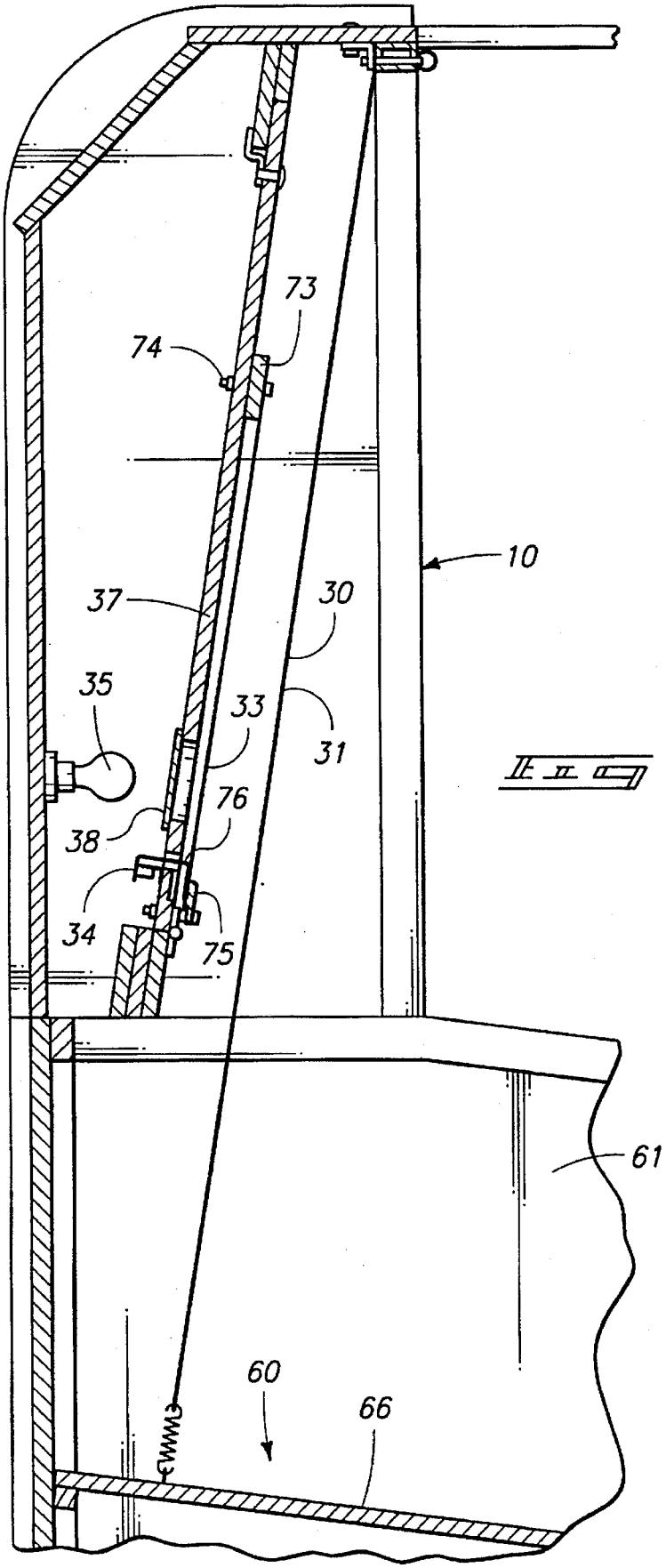
FIG. 13 is an enlarged fragmentary sectional side view of the ball target as seen along line 5—5 in FIG. 3.
Figure 15:
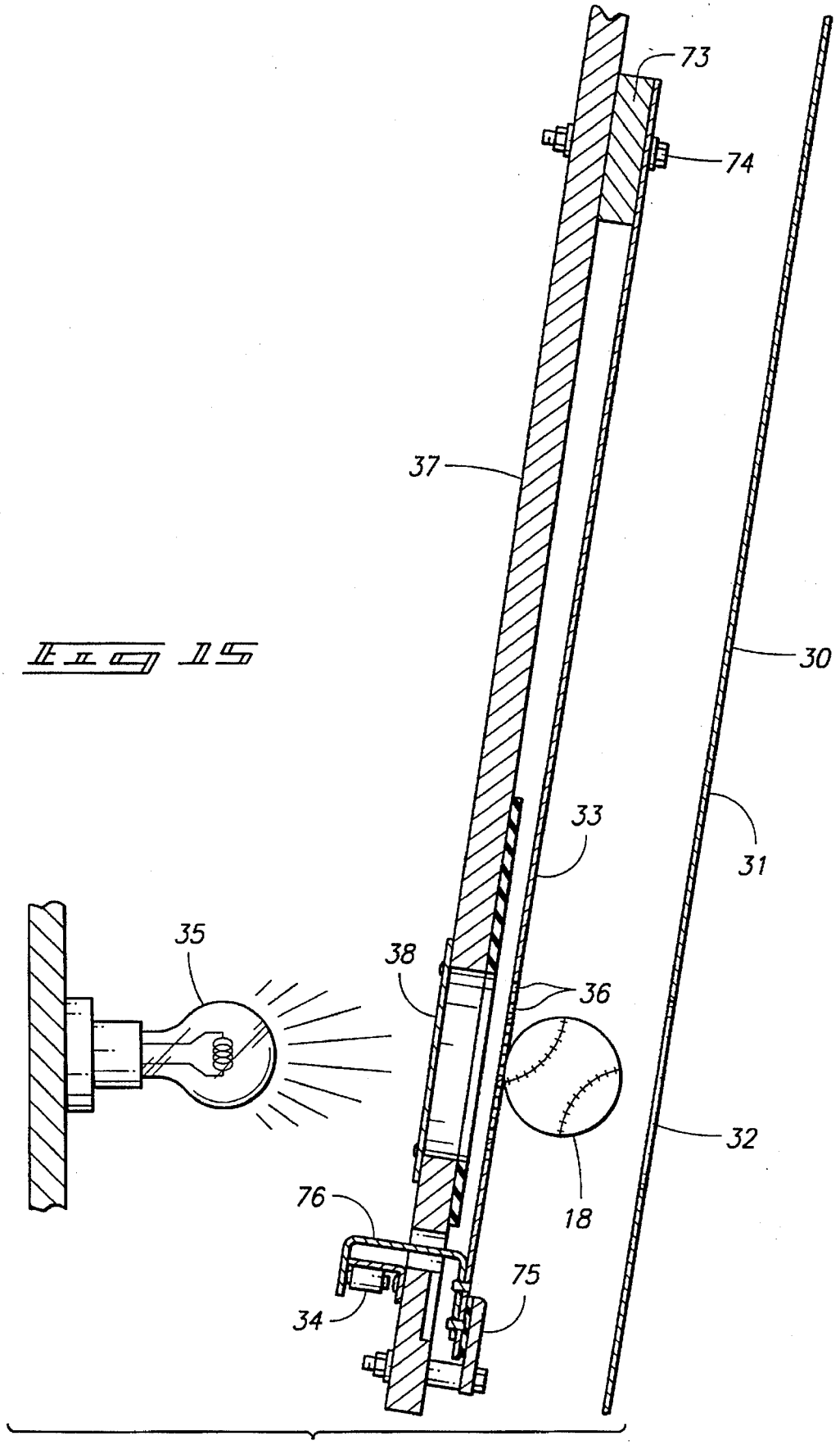
FIG. 15 is an enlarged sectional view taken along line 15—15 in FIG. 14.
Figure 11:
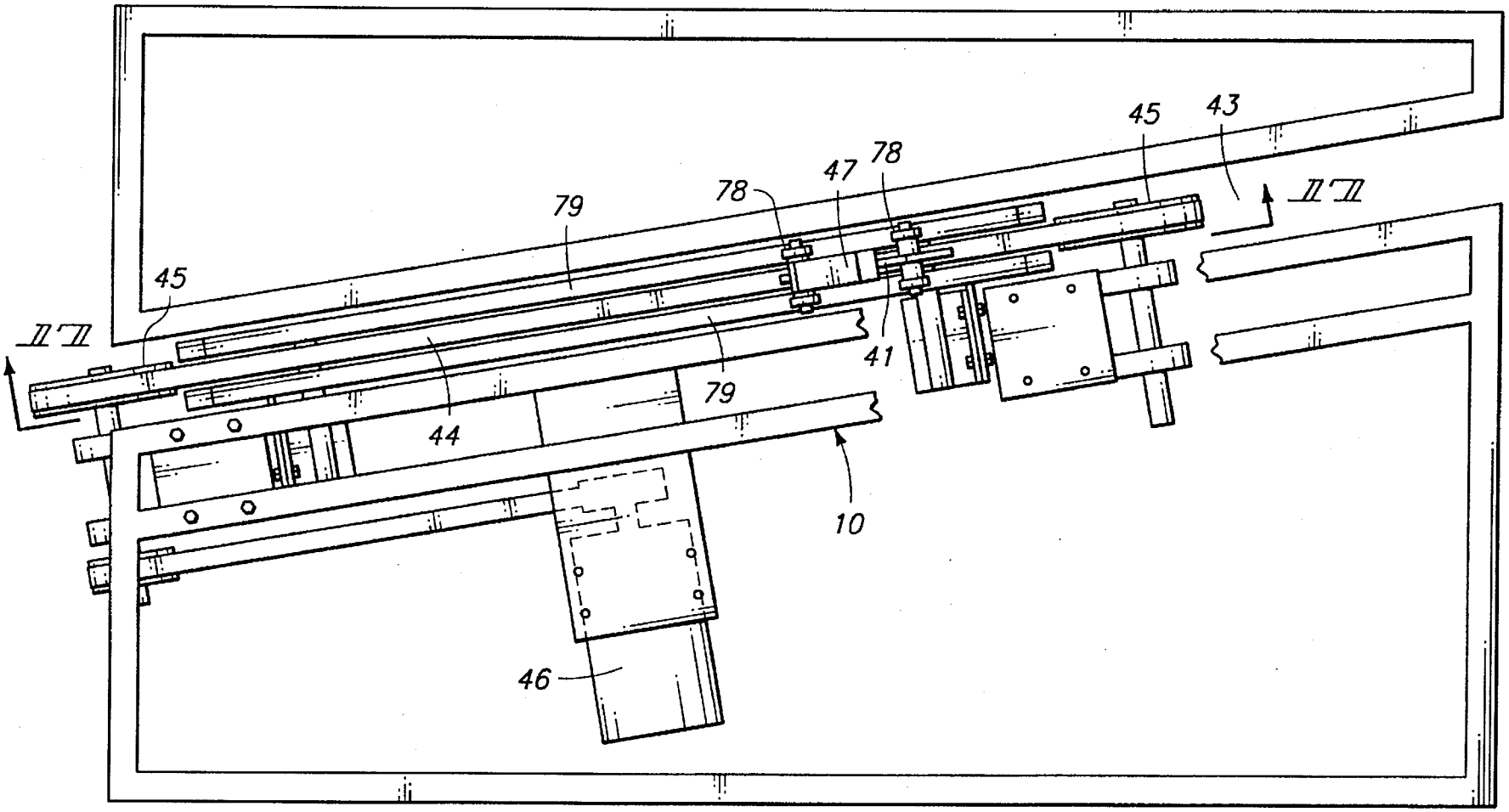
Figure 11:
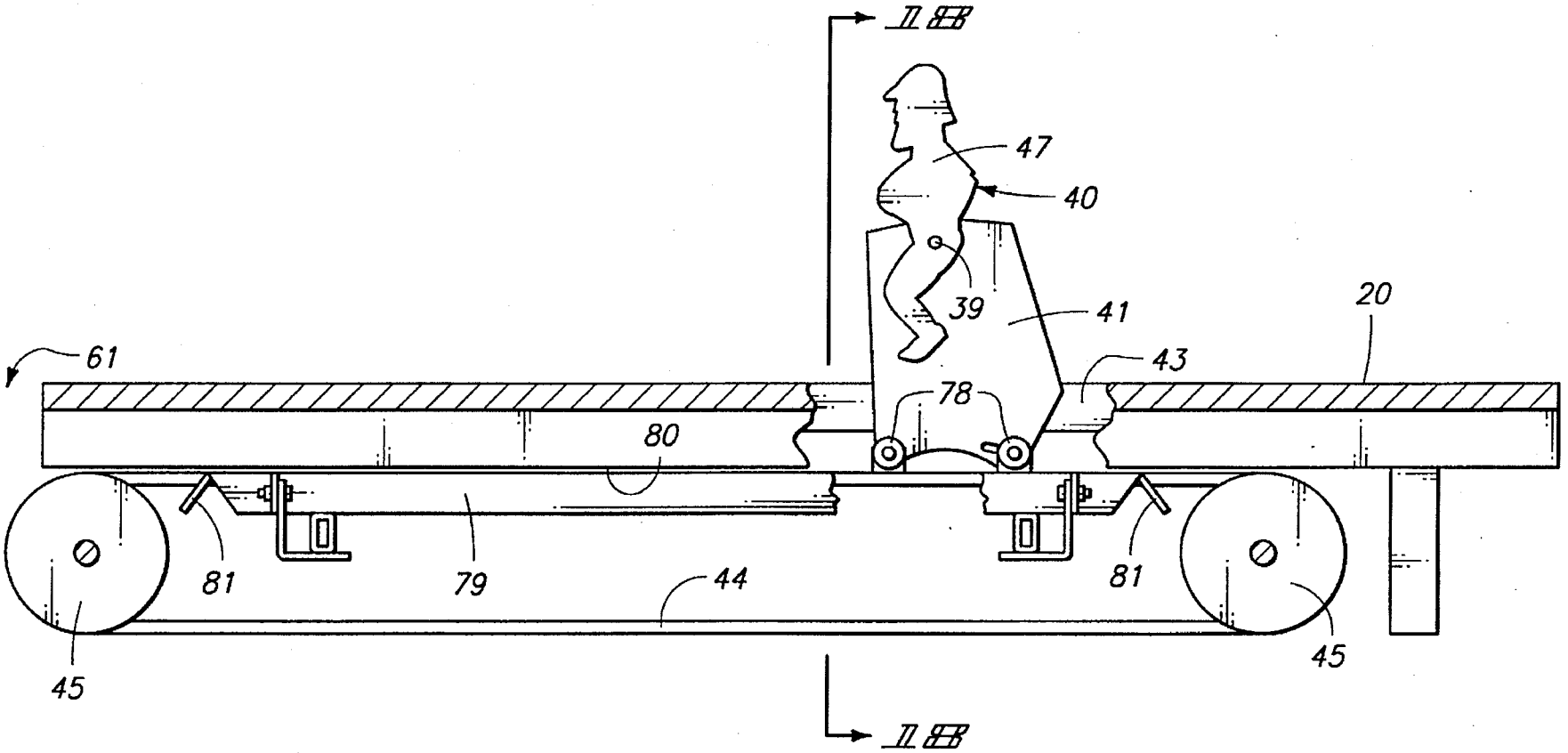

Referring now to FIGS. 13–15, further details relating to the impact plate 33 that detects a ball 18 successfully thrown through the ball target aperture 32 will be described.

The impact plate 33 is a flat metal plate mounted across its top edge by a transverse support block 73 and securing bolts 74. The support block 73 and bolts 74 cantilever the planar impact plate 33 at a spaced distance rearward from the previously-identified access door 37.

A fixed stop 75 overlaps the bottom edge of impact plate 33 to limit its rearward movement. The impact plate 33 is biased into normal engagement against stop 75. A pad of resilient material across the front surface of stop 75 minimizes bouncing of the lower end of the impact plate when it is returned to its normal position as shown in FIG. 15.

Access door 37 is apertured to freely receive a rigid bracket 76 fixed to the bottom end of impact plate 33. Bracket 76 normally engages a target sensing switch 34 fixed to the access door 37. However, any slight forward movement imparted to the impact plate 33 by a thrown ball will cause bracket 76 to be released from engagement against the target sensor 34, thereby sending a signal to controller 70 indicating that a ball has been thrown through the aperture 32. The spring resilience of impact plate 33 immediately returns it to its normal condition in preparation for the next thrown ball.

Figure 18:
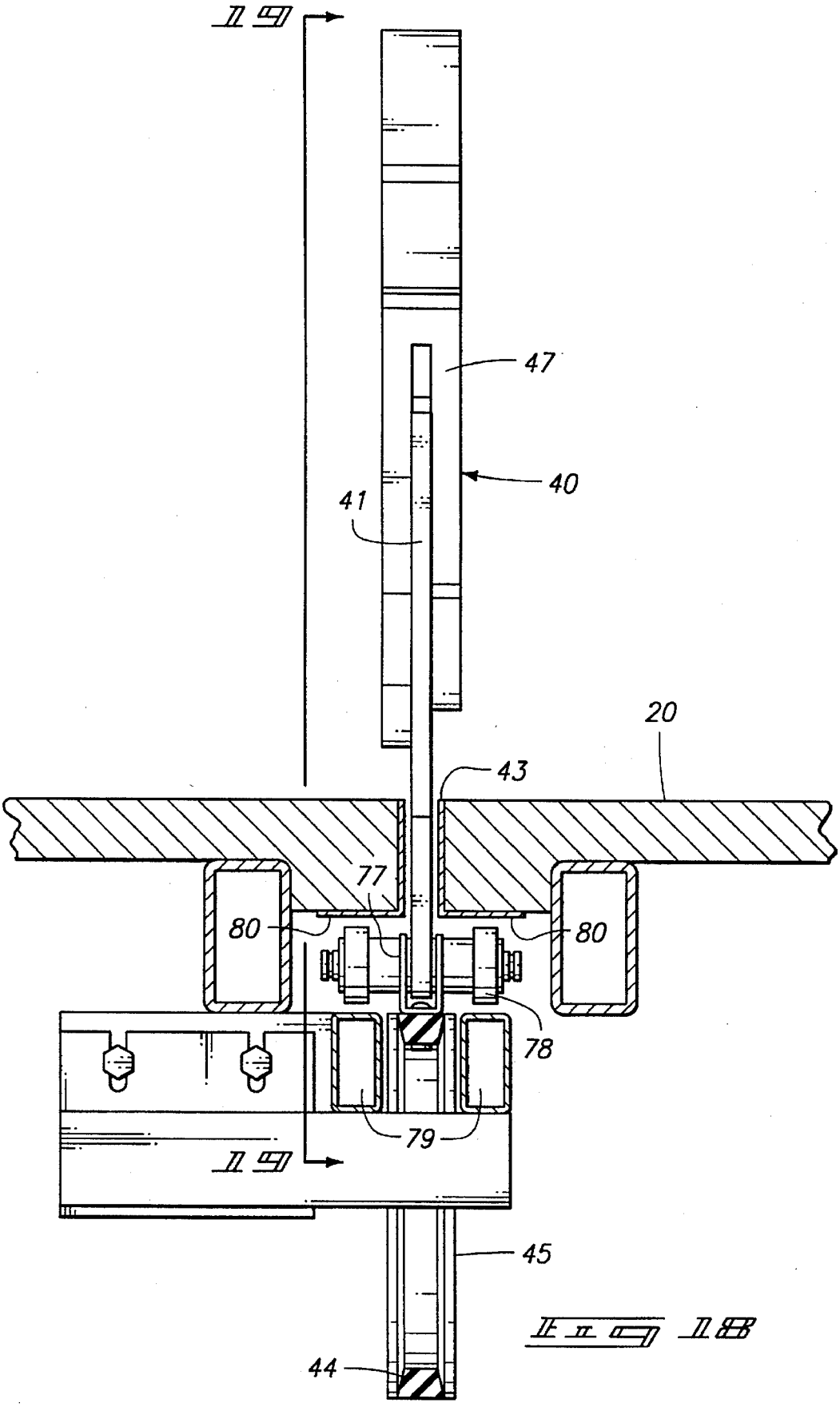
FIG. 18 is an enlarged fragmentary sectional view taken along line 18—18 in FIG. 17.

The mechanical guidance provided to the runner support 41 can best be understood by a study of FIGS. 16–19. The runner support 41 is attached to an endless V-belt 44 by rivets or other permanent fasteners (FIG. 18). The fasteners engage two upwardly open U-shaped brackets 77 that straddle the bottom edge of the vertical runner support 41.

It is preferred that the V-belt 44 be made from a material that is stretchable in a lengthwise direction. The stretch of the belt assists in absorbing shock loads imparted to the simulated runner 40 when struck by a thrown ball 18.

Transverse axles through the brackets 77 rotatably carry paired side rollers 78 which ride between lower side tracks 79 on the framework 10 and upper tracks 80 along the underside of the slotted game table 20. Rolling engagement of the rollers 78 against tracks 79 or 80 assure that the runner support 41 will be accurately positioned in a vertical orientation throughout its path of movement along the upper working flight of endless belt 44.

The ends of tracks 79 are also inclined to facilitate the transition that occurs in the positioning of runner support 41 as it moves about the spaced supporting pulleys 45 that carry endless belt 44. These inclined surfaces are shown in FIG. 17 at 81.

Figure 4:
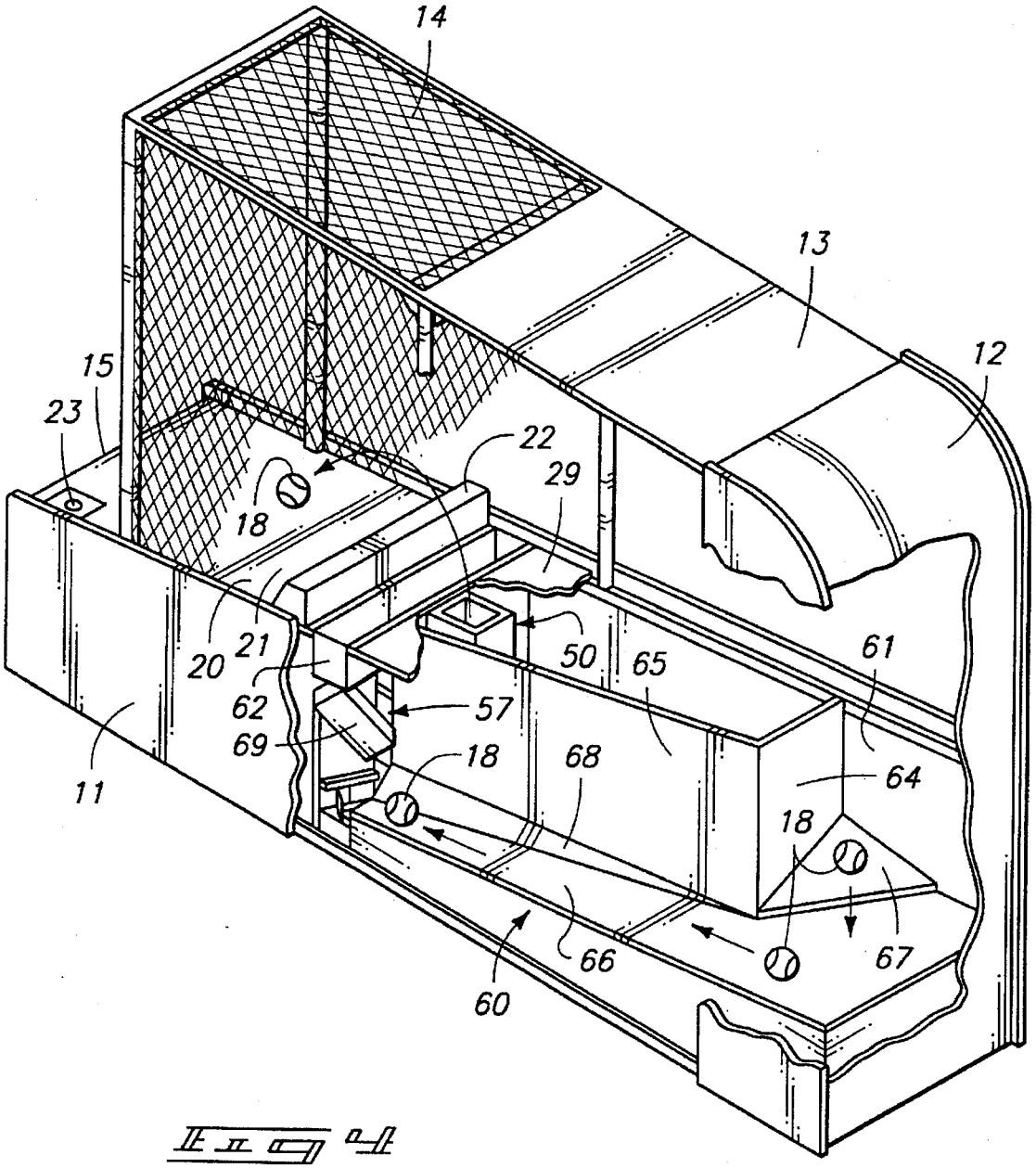
FIG. 4 is a fragmentary rear perspective view illustrating the ball discharge and gravity ball return mechanisms.

Additional details relating to the gravity ball return 60 are visible in FIGS. 4–6, which illustrate the return components, and in FIGS. 9–12, which detail the ball release 57 leading to the pitching machine.

There are two basic areas where thrown balls are collected within the enclosure of the game apparatus. The first is the open area under the ball target 30 and forward of the game table 20. This location is generally designated in the drawings by the reference numeral 61.

The second collection area is a transverse trough 62 extending across the full width of the game table 20 between the rearward end of primary area 29 and the upstanding audible or visual signaling module 22. Trough 62 has a transversely inclined bottom wall leading to an open bottom aperture 63 (FIG. 6) adjacent to one of its sides.

As can be seen in FIGS. 4 and 5, the gravity ball return 60 is bounded by the previously-described forward enclosure 12 and by the side walls 11 of the game apparatus. It is additionally bounded by a fixed interior transverse wall 64 and a fixed interior longitudinal wall 65. The walls 64 and 65 enclose the equipment related to the simulated runner 40 and the ball discharge mechanism 50. They extend upwardly between the gravity ball return 60 and the game table 20. Walls 64 and 65 prevent balls from entering the powered mechanisms that deliver the game balls 18 and that impart motion to the simulated runner 40.

Each ball 18 is directed into the ball release 57 by rolling along the upper suffice of a longitudinally inclined wall 66 that leads from the forward enclosure 12 to the ball release 57. Fixed triangular walls 67 and 68 are included in the corners adjacent to walls 64 and 65 to gravitationally urge each ball toward one side of the longitudinally inclined wall 66 as they roll rearwardly along it.

Each ball that drops through aperture 63 within the trough 62 falls upon a forwardly inclined chute 69 which deposits the ball along the longitudinally inclined wall 66. Thus, whether a ball rolls rearwardly along game table 20 or is dropped forwardly or rearwardly of the backdrop 31 within ball target 30, it will eventually be rolling along the rear most end of inclined wall 66 in a narrowing lane defined by the adjacent side wall 11 of the enclosure and the widened rearward end of triangular wall 68. This prevents "bridging" of two or more balls 18 across the wall 66.

Details of the ball release 57 are shown in FIGS. 9–12. The illustrated ball release 57 is located transversely across the game framework 10 at a location under the trough 62 (see FIGS. 5 and 7).

Incoming balls are received onto a pair of inclined rails 82 between front and back confining upright walls 83, 84. As the balls roll along rails 82, the first ball of a group will cause the ball detector 58 (FIG. 10) to trip, thereby signaling controller 70 that a ball 18 is available for use.

Figure 10:
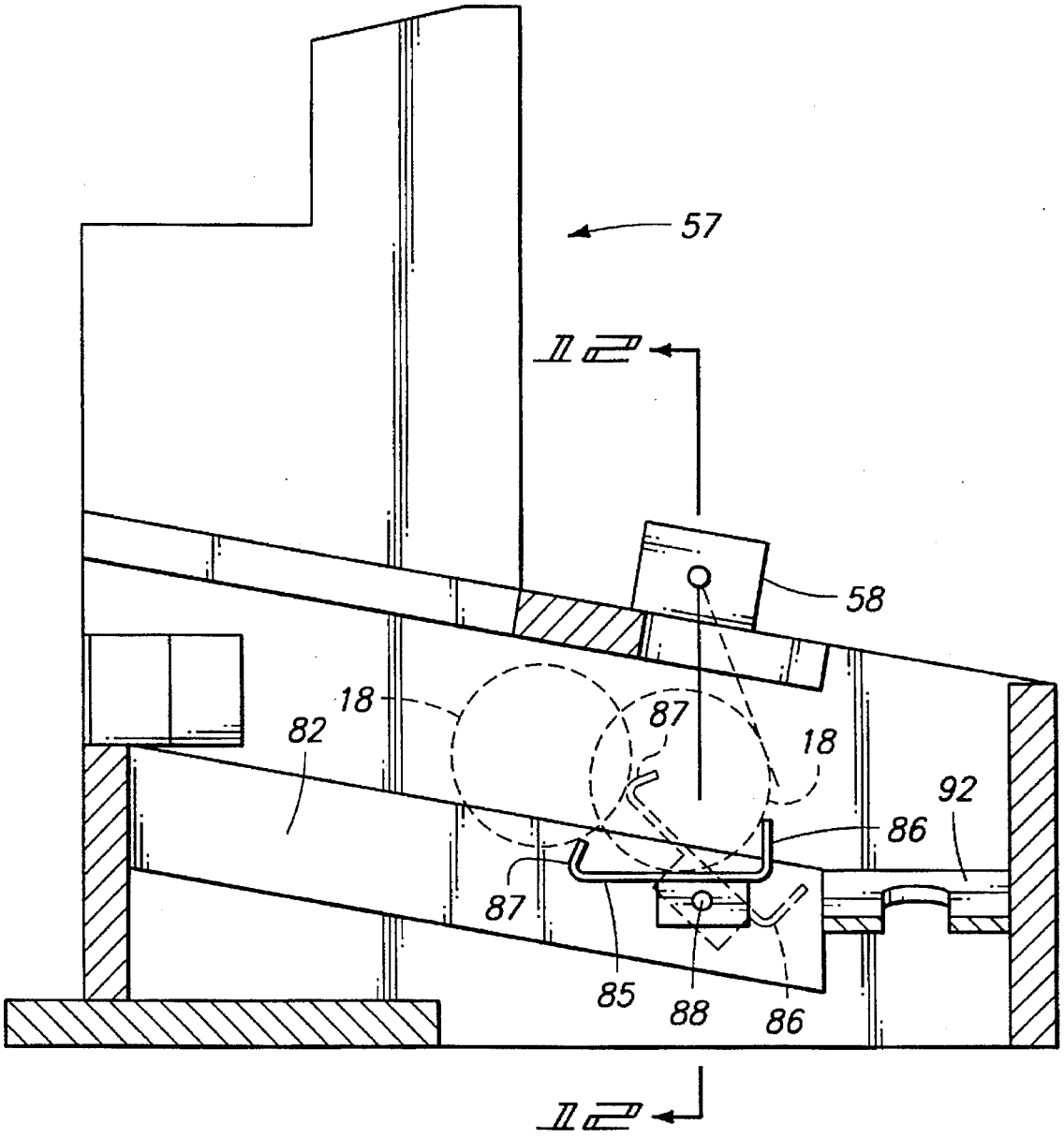
FIG. 10 is a front elevation view of the ball release, the forward wall shown in FIG. 9 being removed.
Figure 11:
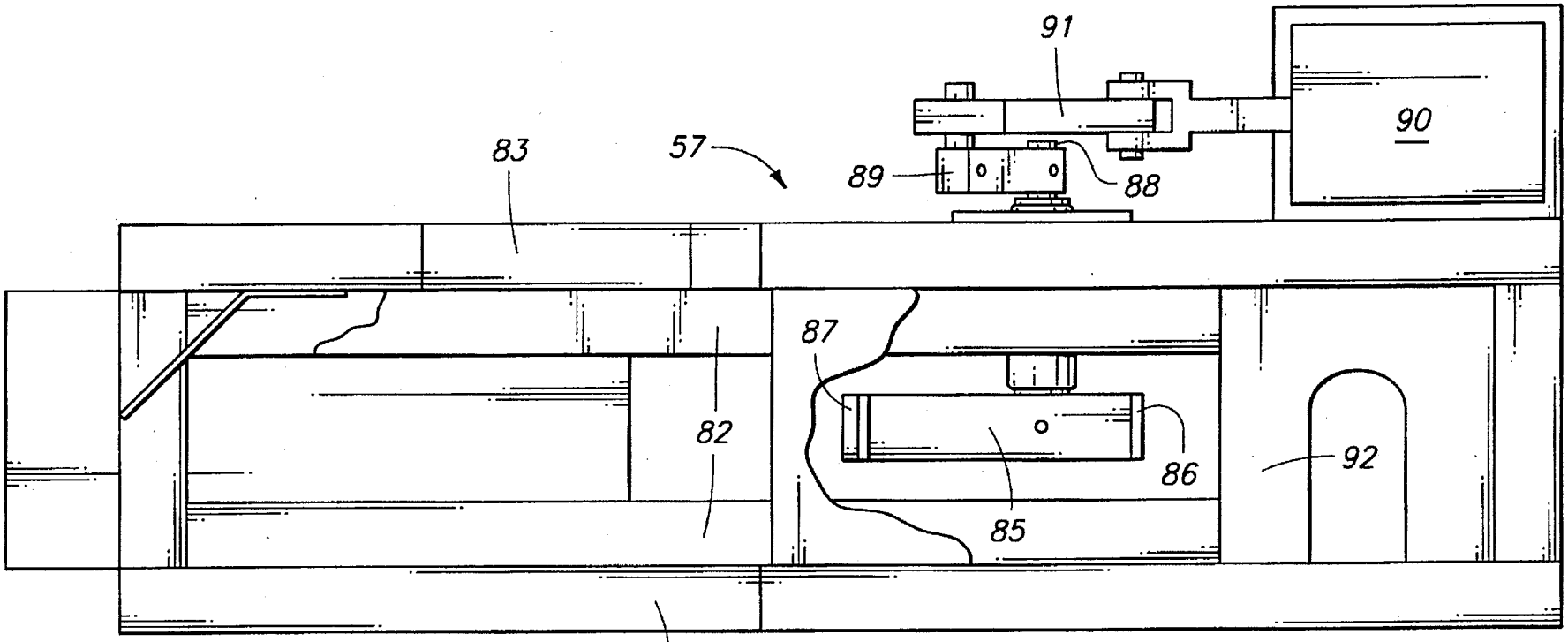

The first ball held within the ball release 57 rests in a stationary position on a bent stepper 85 located between the rails 82. The alternate or release position of stepper 85 is shown in FIG. 10 in dashed lines.

Stepper 85 includes a first upturned lip 86 to prevent further rolling of an initial ball rolling along the inclined rails 83, 84. The opposite end of stepper 85 has an upturned lip 87 which prevents further rolling of an abutting ball 18 (shown in dashed lines in FIG. 10) as each ball 18 is released by the lowering motion of lip 86.

Figure 11:
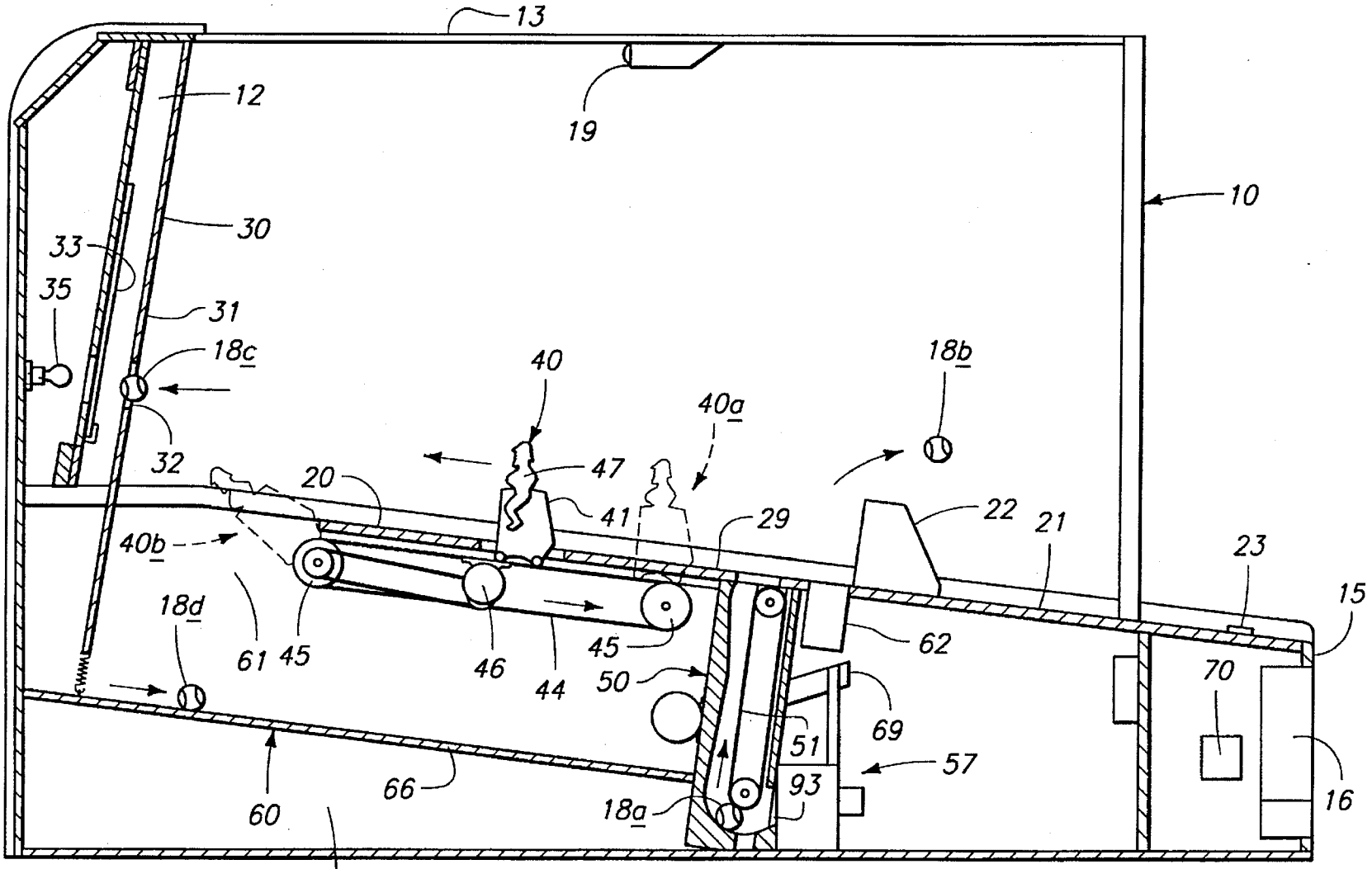
FIG. 11 is a fragmentary top plan view of the ball release.
Figure 12:
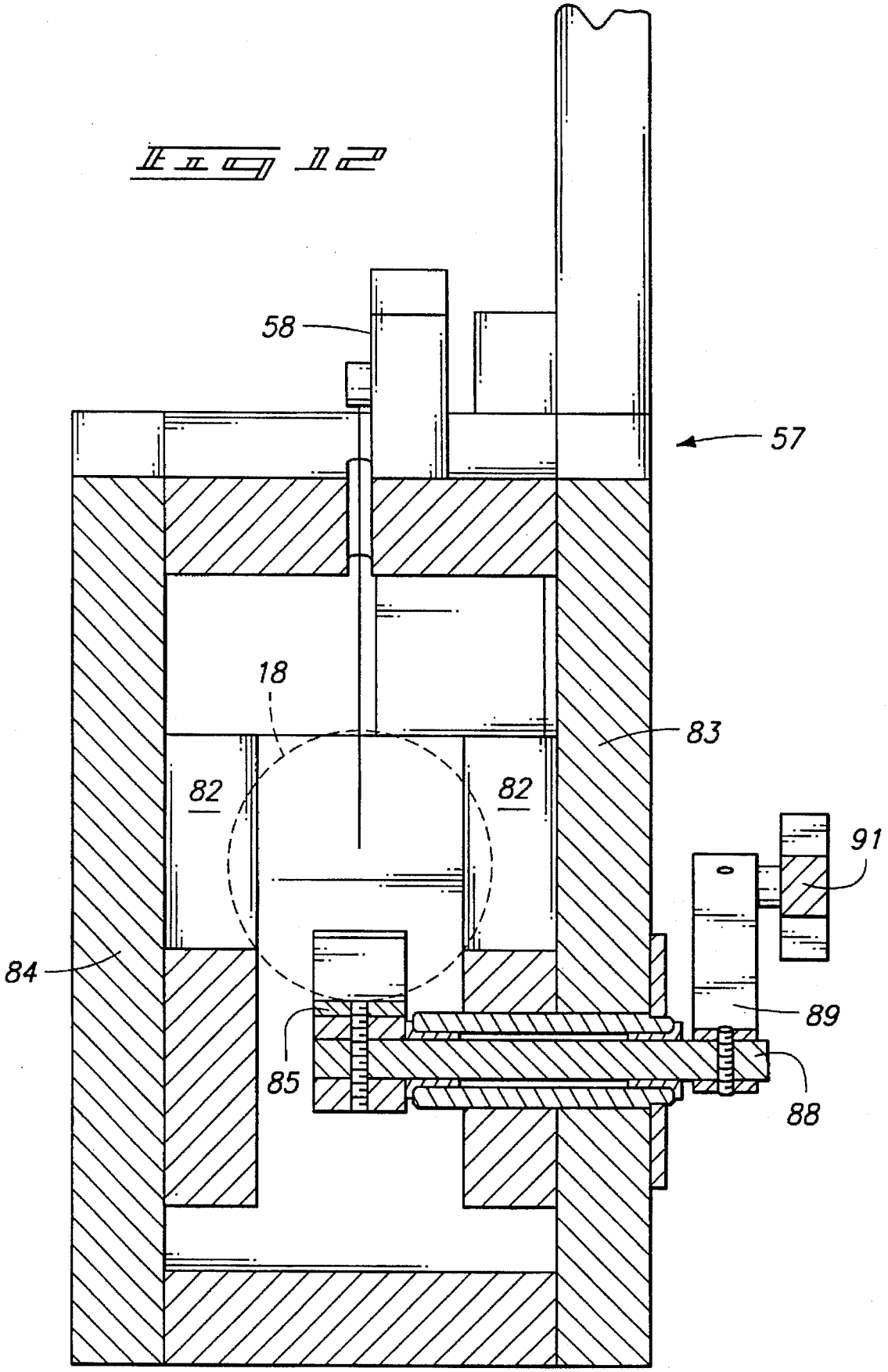

Stepper 85 is fixed to a mounting shaft 88 rotatably journalled within the front wall 83 of the ball release 57 (FIGS. 11, 12). A radial crank arm 89 fixed to shaft 88 controls the angular position of shaft 88 and stepper 85 relative to the ball release 57. Crank arm 89 is interconnected to an operational solenoid 90 by a pivoted linkage 91 that converts the reciprocating movement of solenoid 90 to pivotal movement of shaft 88. Solenoid 90 is wired to controller 70, which sequences the operation of solenoid 90 to supply individual balls to the pitching machine as required during a game cycle.

As each ball is released by the tipping action of the stepper 85, it is free to roll along the rails 82 and onto a longitudinally inclined ramp 92, which is slotted to turn the direction of movement of each ball 90° as it is discharged through an opening 93 in the back wall 84 of the ball release 57.

FIG. 20 schematically illustrates the various interconnections between the controller 70 and the controlling sensors and switches and the motors and signaling module as previously described. The controller 70, which might be a general-purpose computer or microprocessor, is preferably software driven, thereby allowing for revisions in the game cycle as might be desired. The design and use of such a controller is well within the knowledge of computer hardware and software designers today.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An interactive ball throwing game, comprising:

a rigid supporting framework extending longitudinally from a player station;

a longitudinal game table in the form of an upwardly facing game table extending between a rearward end adjacent to the player station and a longitudinally spaced forward end;

an upright ball target mounted across and elevationally above the forward end of the game table;

a simulated runner for movement along a longitudinal path on the game table between a rearward starting position and a finishing position adjacent to the ball target;

a ball discharge mechanism for selectively delivering individual balls toward the rearward end of the game table for use by a player; and a controller operably connected to the ball discharge mechanism and the runner for initiating movement of the runner along its path from its starting position in response to activation of the ball discharge mechanism.

2. The interactive ball throwing game of claim 1, further comprising:

a target sensor activated when a ball has been successfully thrown to the ball target by a player;

the controller being operably connected to the target sensor for determining whether the target sensor is activated prior to the runner reaching its finishing position.

3. The interactive ball throwing game of claim 1, further comprising:

a target sensor activated when a ball has been successfully thrown to the ball target by a player; and an audible or visual signaling module for communicating message information to a human player concerning game progress;

the controller being operably connected to the target sensor and the audible or visual signaling module for determining whether the target sensor is activated prior to the runner reaching its finishing position and for communicating selected message information dependent upon whether or not this sequence of play has occurred.

4. The interactive ball throwing game of claim 1, wherein the ball target comprises:

an upright transverse backdrop spaced forwardly from the game table;

the backdrop including an aperture formed through it as a ball target area;

an impact plate movably mounted behind the aperture; and a target sensor operably connected to the impact plate for activation when the impact plate is contacted by a thrown ball.

5. The interactive ball throwing game of claim 1, wherein the ball discharge mechanism ejects an individual ball in a longitudinal trajectory extending rearwardly over the game table and toward the player station.

6. The interactive ball throwing game of claim 1, wherein the ball discharge mechanism is a pitching machine recessed under the game table at a longitudinal location between its rearward and forward ends for selectively ejecting individual balls in a longitudinal rearward trajectory that extends over the game table.

7. The interactive ball throwing game of claim 1, wherein the ball discharge mechanism is a pitching machine recessed under the game table which imparts backspin to each ball as it is ejected in a longitudinal rearward trajectory that extends over the game table.

8. The interactive ball throwing game of claim 1, wherein the ball discharge mechanism is a pitching machine recessed under the game table; the pitching mechanism comprising:

a continuously-operated ball conveyor having a working flight for ejecting individual bails in a longitudinal rearward trajectory that extends over the game table; and a ball release for directing individual balls to the working flight.

9. The interactive ball throwing game of claim 1, wherein the ball discharge mechanism is a pitching machine recessed under the game table; the pitching mechanism comprising:

a continuously-operated ball conveyor having a working flight for ejecting individual balls in a longitudinal rearward trajectory that extends over the game table; and the controller being operably connected to the ball release and the runner for simultaneously initiating movement of the runner and activating the ball release.

10. The interactive ball throwing game of claim 1, wherein the ball discharge mechanism is a pitching machine recessed under the game table; the pitching machine comprising:

a continuously-operated ball conveyor having a working flight; and an opposed stationary surface overlying at least a portion of the ball conveyor for imparting backspin to each ball as it is ejected.

11. The interactive ball throwing game of claim 1, wherein the longitudinal path of the simulated runner extends at an acute angle relative to the longitudinal length of the game table.

12. The interactive ball throwing game of claim 1, wherein the simulated runner is a mechanically movable figure positioned on and protruding upwardly from the game table during movement between its starting and finishing positions.

13. The interactive ball throwing game of claim 1, wherein the simulated runner comprises:

a runner support movably mounted on the framework;

a mechanically movable figure pivotally supported about a transverse axis on the runner support; and a spring operably connected between the runner support and the movable figure for normally biasing the figure in an upright position while permitting the figure to move relative to the runner support in a forward direction over its transverse axis.

14. An interactive baseball throwing game, comprising:

a rigid supporting framework extending longitudinally from a player station;

a longitudinal game table in the form of an upwardly facing game table that is inclined upwardly between a rearward end adjacent to the player station and a longitudinally spaced forward end;

an upright ball target mounted across and spaced from the forward end of the game table, the ball target having an upwardly and rearwardly inclined back surface including indicia simulating a base and a defensive baseball player guarding the base;

at least one ball adapted to be manually thrown to the ball target by a player at the player station;

a simulated mechanical runner mounted to the framework for selective movement along a longitudinal base path on the game table between a rearward starting position and a finishing position adjacent to the ball target;

a ball discharge mechanism recessed within the game table at a location longitudinally spaced from its rearward end for selectively ejecting individual balls in a longitudinal trajectory that extends over the game table and toward its rearward end for use by a human player; and a controller operably connected to the ball discharge mechanism and the runner for initiating movement of the runner along its path from its starting position in response to activation of the ball discharge mechanism.

15. The interactive baseball throwing game of claim 14, wherein the back surface of the ball target is formed on a flexible backdrop yieldably suspended on the framework.

16. The interactive baseball throwing game of claim 14, wherein the back surface of the ball target is formed on a flexible backdrop yieldably suspended on the framework;

the backdrop having an aperture formed through it and being dimensioned to permit free passage of a ball; and a target sensor mounted on the framework, the target sensor including an impact plate spaced forwardly from the backdrop in longitudinal alignment with the aperture for activation when a ball has been successfully thrown through the aperture by a human player;

the controller being operably connected to the target sensor for determining whether the sensor is activated prior to the runner reaching its finishing position.

17. The interactive baseball throwing game of claim 14, wherein the back surface of the ball target is formed on a flexible backdrop yieldably suspended on the framework;

the backdrop having an aperture formed through it and being dimensioned to permit free passage of a ball;

a target sensor mounted on the framework, the target sensor including an input plate having a light-transmitting area spaced forwardly from the backdrop in longitudinal alignment with the aperture for activation when a ball has been successfully thrown through the aperture by a human player; and a light souce located on the framework at a location forward of the light-transmitting area of the impact plate.

18. The interactive baseball throwing game of claim 14, wherein the back surface of the ball target is formed on a flexible backdrop yieldably suspended on the framework;

the backdrop having an aperture formed through it and being dimensioned to permit free passage of a ball;

a target sensor mounted on the framework, the target sensor including an impact plate having a light-transmitting area spaced forwardly from the backdrop in longitudinal alignment with the aperture for activation when a ball has been successfully thrown through the aperture by a human player; and a light source located on the framework at a location forward of the light-transmitting area of the impact plate;

the controller being operably connected to the ball and to the light source for selectively activating the light source in response to activation of the ball discharge mechanism.

19. The interactive baseball throwing game of claim 14, wherein the planar rear surface of the ball target is formed on a flexible backdrop yieldably suspended on the framework;

the backdrop having an aperture formed through it and being dimensioned to permit free passage of a ball;

a target sensor mounted on the framework, the target sensor including an impact plate spaced forwardly from the backdrop in longitudinal alignmemt with the aperture for activation when a ball has been successfully thrown through the aperture by a player; and an audible or visual signaling module for communicating message information concerning game progress to a player;

the controller being operably connected to the target sensor for determining whether the target sensor is activated prior to the runner reaching its finishing position.

20. The interactive baseball throwing game of claim 14, wherein the ball discharge mechanism is a pitching machine recessed under the game table, the pitching machine comprising a ball conveyor that selectively ejects each ball in a longitudinal trajectory extending rearwardly over the game table and toward the player station.

21. The interactive baseball throwing game of claim 14, wherein the ball discharge mechanism is a pitching machine recessed under the game table, the pitching machine comprising a continuously-operated ball conveyor having a working flight and an opposed stationary surface overlying at least a portion of the ball conveyor for imparting backspin to each ball as it is ejected;

the pitching machine further comprising a ball release for directing individual balls onto the working flight of the pitching mechanism.

22. The interactive baseball throwing game of claim 14, wherein the ball discharge mechanism is a pitching machine recessed under the game table, the pitching machine comprising a continuously-operated ball conveyor having a working flight and an opposed stationary surface overlying at least a portion of the ball conveyor for imparting backspin to each ball as it is ejected;

the pitching machine further comprising a ball release for directing individual balls onto the working flight of the pitching mechanism; and the controller being operably connected to the ball release and the runner for simultaneously initiating movement of the runner and activating the ball release.

23. The interactive baseball throwing game of claim 14, wherein the ball discharge mechanism is a pitching machine recessed under the game table, the pitching machine comprising a continuously-operated ball conveyor having a working flight and an opposed stationary surface overlying at least a portion of the ball conveyor for imparting backspin to each ball as it is ejected;

the pitching machine further comprising a ball release for directing individual balls onto the working flight of the pitching mechanism; and a gravity ball return extending along the framework at an elevation beneath the game table for directing individual balls to the ball release after they have been thrown toward the ball target.

24. The interactive baseball throwing game of claim 14; wherein each ball is a compressible ball having a nominal diameter substantially equal to the diameter of a conventional rigid playing ball;

the ball discharge mechanism being a pitching machine recessed under the game table;

the pitching machine comprising a continuously-operated ball conveyor having an upright working flight engaged about a upper and lower pulleys on the framework, the lower pulley being rotatably mounted about a fixed transverse axis on the framework and the upper pulley being mounted about a parallel axis spaced elevationally above the fixed transverse axis;

an opposed upright stationary surface overlying at least a portion of the working flight of the ball conveyor to impart backspin to each ball as it is rolled upwardly against the stationary surface by motion of the working flight of the ball conveyor; and a lower end of the stationary surface being spaced from and wrapped about the lower pulley at a spacing less than the nominal diameter of a ball to block passage of a rigid playing ball having a diameter at least as great as such nominal diameter.

25. The interactive baseball throwing game of claim 14, wherein the runner comprises:

a runner support movably mounted on the framework;

a movable figure pivotally supported about a transverse axis on the runner support; and a spring operably connected between the runner support and the movable figure for normally biasing the figure to an upright position while permitting the figure to move relative to the runner support in a forward direction over its transverse axis.

26. The interactive ball throwing game of claim 14, wherein the runner comprises:

a runner support movably mounted on the framework along an endless conveyor including an upper working flight extending between front and rear rotational supports the working flight being parallel to and recessed beneath the game table; and a movable figure pivotally supported about a transverse axis on the runner support.

27. An interactive ball throwing game, comprising:

a rigid supporting framework extending longitudinally from a player station;

a longitudinal game table extending between a rearward end adjacent to the player station and a longitudinally spaced forward end; and a ball discharge mechanism for selectively ejecting an individual ball in a longitudinal trajectory extending rearwardly over the game table and toward the player station;

the ball discharge mechanism being a pitching machine recessed under the game table at a longitudinal location intermediate its rearward and forward ends which imparts backspin to each ball as it is ejected in a longitudinal rearward trajectory that extends over the game table.

28. The interactive ball throwing game of claim 27, wherein the ball discharge mechanism is a pitching machine recessed under the game table, the pitching machine comprising a continuously-operated ball conveyor having a working flight and an opposed stationary surface overlying at least a portion of the ball conveyor for imparting backspin to each ball as it is ejected; and the pitching machine further comprising a ball release for directing individual balls onto the working flight of the pitching mechanism.

29. The interactive ball throwing game of claim 27, wherein the ball discharge mechanism is a pitching machine recessed under the game table, the pitching machine comprising a continuously-operated ball conveyor having a working flight and an opposed stationary surface overlying at least a portion of the ball conveyor for imparting backspin to each ball as it is ejected;

the pitching machine further comprising a ball release for directing individual bails onto the working flight of the pitching mechanism; and a gravity ball return extending along the framework at an elevation beneath the game table for directing individual balls to the ball release.

30. The interactive ball throwing game of claim 27, further comprising:

at least one compressible ball having a nominal diameter substantially equal to the diameter of a conventional rigid playing ball;

the ball discharge mechanism being a pitching machine recessed under the game table;

an opposed upright stationary surface overlying at least a portion of the working flight of the ball conveyor to impart backspin to each ball as it is rolled upwardly against the stationary surface by motion of the working flight of the ball conveyor;

a lower end of the stationary surface being spaced from and wrapped about the lower pulley at a spacing less than the nominal diameter of a ball to block passage of a rigid playing ball having a diameter at least as great as such nominal diameter.

31. An interactive ball throwing game, comprising:

a rigid supporting framework extending longitudinally from a player station;

a longitudinal game table extending between a rearward end adjacent to the player station and a longitudinally spaced forward end;

an upright ball target mounted across and elevationally above the forward end of the game table; and a simulated runner for movement along a longitudinal path on the game table between a starting position adjacent to the player station and a finishing position adjacent to the ball target;

the runner comprising:

a runner support movably mounted on the framework;

a movable figure pivotally supported about a transverse axis on the runner support; and a spring operably connected between the runner support and the movable figure for normally biasing the figure to an upright position while permitting the figure to move relative to the runner support in a forward direction over its transverse axis.

32. The interactive ball throwing game of claim 31, wherein the runner support is movably mounted on the framework along an endless conveyor including an upper working flight extending between front and rear rotational supports the working flight being parallel to and recessed beneath the game table.

33. A method for playing an interactive ball throwing game, comprising:

providing a longitudinal game table that extends between a rearward end adjacent to a player station and a longitudinally spaced forward end;

locating an upright ball target across and elevationally above the forward end of the game table;

selectively delivering individual balls toward the rearward end of the game table for use by a player attempting to toss each ball to the ball target; and causing a simulated runner to move along a longitudinal path on the game table between a starting position adjacent to the player station and a finishing position adjacent to the ball target, movement of the runner along its path from its starting position being initiated in response to delivery of each ball.

34. The method for playing an interactive ball throwing game of claim 33, further comprising:

sensing when a ball has been successfully thrown to the ball target by a player; and determining whether the sensor is activated prior to the runner reaching its finishing position.

35. The method for playing an interactive ball throwing game of claim 33, further comprising:

sensing when a ball has been successfully thrown to the ball target by a player;

determining whether the sensor is activated prior to the runner reaching its finishing position; and communicating selected message information to a player by activation of an audible or visual signaling module, the selected message information being dependent upon whether or not this sequence of play has been achieved.

36. The method for playing an interactive ball throwing game of claim 33, wherein the delivering step ejected individual balls in a longitudinal trajectory extending rearwardly over the game table and toward the player station.

37. The method for playing an interactive ball throwing game of claim 33, wherein the delivering step ejects individual balls from under the game table at a longitudinal location intermediate its rearward and forward ends in a longitudinal trajectory extending rearwardly over the game table and toward the player station.

38. The method for playing an interactive ball throwing game of claim 33, wherein the delivering step imparts backspin to each ball as it is ejected in a longitudinal rearward trajectory that extends over the game table.

39. The method for playing an interactive ball throwing game of claim 33, wherein the delivering step comprises the following sub-steps:

continuously operating a ball conveyor having a working flight that ejects individual balls in a longitudinal rearward trajectory that extends over the game table; and selectively directing individual balls onto the working flight.

40. The method for playing an interactive ball throwing game of claim 33, wherein the delivering step comprises the following sub-steps:

continuously operating a ball conveyor having a working flight that ejects individual balls in a longitudinal rearward trajectory that extends over the game table;

selectively directing individual balls onto the working flight; and simultaneously initiating movement of the runner as each ball id directed onto the working flight.

41. The method for playing an interactive ball throwing game of claim 33, wherein the delivering step comprises the following sub-step:

continuously operating an upright ball conveyor having a working flight that rollingly engages each ball in opposition to an adjacent upright stationary surface to impart backspin to it as it is ejected in a longitudinal rearward trajectory that extends over the game table.

42. The method for playing an interactive ball throwing game of claim 33, wherein the delivering step comprises the following sub-steps:

continuously operating a ball conveyor having a working flight that ejects individual balls in a longitudinal rearward trajectory that extends over the game table and an opposed stationary surface overlying at least a portion of the ball conveyor to impart backspin to each ball as it is ejected;

individually releasing each ball to direct it onto the ball conveyor; and initiating movement of the runner simultaneously with the release of each ball.

43. The method for playing an interactive ball throwing game of claim 33, wherein the simulated runner is moved along a longitudinal path that extends at an acute angle relative to the longitudinal length of the game table.

* * * * *